US007082738B2

(12) United States Patent
Konishi et al.

(10) Patent No.: US 7,082,738 B2
(45) Date of Patent: Aug. 1, 2006

(54) CAPSULE-FILLING AND SEALING APPARATUS

(75) Inventors: Hirokazu Konishi, Sakurai (JP); Takashi Matsunaga, Osaka (JP)

(73) Assignee: Shionogi Qualicaps Co., Ltd., Nara (JP)

( * ) Notice: Subject to any disclaimer, the term of this patent is extended or adjusted under 35 U.S.C. 154(b) by 43 days.

(21) Appl. No.: 10/520,447

(22) PCT Filed: Jun. 26, 2003

(86) PCT No.: PCT/JP03/08155

§ 371 (c)(1),
(2), (4) Date: Jan. 5, 2005

(87) PCT Pub. No.: WO2004/004628

PCT Pub. Date: Jan. 15, 2004

(65) Prior Publication Data

US 2005/0217207 A1 Oct. 6, 2005

(51) Int. Cl.
*B65B 1/04* (2006.01)

(52) U.S. Cl. ..... 53/281; 53/53; 53/329; 53/900

(58) Field of Classification Search ..... 53/53, 53/281, 282, 329, 329.2, 900
See application file for complete search history.

(56) References Cited

U.S. PATENT DOCUMENTS 3,538,677 A * 11/1970 Tollefsbol et al. ..... 53/282
4,223,751 A * 9/1980 Ayers et al. ..... 177/210 C
4,584,817 A * 4/1986 Yamamoto et al. ..... 53/329.2
4,731,979 A * 3/1988 Yamamoto et al. ..... 53/281
4,793,119 A * 12/1988 Maso ..... 53/329.2
4,802,323 A * 2/1989 Garris et al. ..... 53/900
4,901,865 A * 2/1990 Staples ..... 53/900
4,959,943 A * 10/1990 Yamamoto et al. ..... 53/282
4,964,262 A * 10/1990 Moser et al. ..... 53/900
4,991,377 A * 2/1991 Marchesini ..... 53/900
5,018,335 A * 5/1991 Yamamoto et al. ..... 53/281
5,054,258 A * 10/1991 Tait et al. ..... 53/329
5,081,822 A * 1/1992 Boyd et al. ..... 53/281
5,209,040 A * 5/1993 Yamamoto et al. ..... 53/137.2
5,602,485 A * 2/1997 Mayer et al. ..... 324/663
5,743,069 A * 4/1998 Ansaloni ..... 532/282
5,930,984 A * 8/1999 Furuya et al. ..... 53/900
6,108,030 A * 8/2000 Yamamoto et al. ..... 53/900

FOREIGN PATENT DOCUMENTS

| | | |
|---|---|---|
| JP | 57-093824 | 6/1982 |
| JP | 60-190964 | 9/1985 |
| JP | 61-068050 | 4/1986 |
| JP | 01-232962 | 9/1989 |
| JP | 05-038357 | 2/1993 |
| JP | 09-206699 | 8/1997 |
| JP | 10-501718 T | 2/1998 |

* cited by examiner

*Primary Examiner*—Louis Huynh
(74) *Attorney, Agent, or Firm*—Sheridan Ross P.C.

(57) ABSTRACT

The capsule filling-sealing apparatus in accordance with the present invention comprises a filling unit in which various mechanisms for carrying out filling processing for empty capsules are functionally disposed, a sealing unit for securely sealing filled capsules, and a connection unit for transferring the filled capsules from the filling unit to the sealing unit, wherein the filling unit, the connection unit and the sealing unit are disposed organically and integrated substantially, and the sealing processing is carrying out sequentially after the filling processing on the same production line without requiring unnecessary storage and transfer after the filling processing for capsules.

13 Claims, 20 Drawing Sheets

(B)

(A)

CAPSULE-FILLING AND SEALING APPARATUS

TECHNICAL FIELD

The present invention relates to a capsule filling-sealing apparatus for filling capsules made of a water-soluble material, such as gelatin or cellulose, with medicines or food products and for sealing the capsules.

BACKGROUND ART

A capsule comprising a connection of a body and a cap is filled with a filling material serving as an ingredient in the form of powder, granule, liquid, etc. and sealed, whereby a capsule is formed. In the production of this kind of capsule medicine, a capsule sealing apparatus for sealing the body and the cap is used to ensure secure connection between the body and the cap, to prevent malicious opening and, in the case of a liquid filling material in particular, to prevent the ingredient from leaking from the capsule. In addition, the oxidation stability and deodorization effect of a filling material can be enhanced by sealing the capsule using the capsule sealing apparatus. Furthermore, an identification function can be enhanced further by coloring a sealing material. Since the capsule sealing processing is very important processing as described above, various capsule sealing apparatuses have been developed. FIG. 21 is a side view showing the entire configuration of the capsule sealing apparatus disclosed in the Official Gazette of Japanese Examined Patent Publication No. Hei 2-946 applied by the applicant of the present invention.

As shown in FIG. 21, the conventional capsule sealing apparatus comprises a capsule feeding means provided with a hopper 1 for randomly accommodating a plurality of capsules filled with a filling material, a feed drum 2, etc., a capsule orienting means provided with a rectifier roller 3, a guide plate 4, a transfer roller 5, a guide plate 6, etc., a transfer means provided with slats 7, a bottom plate 8, etc., a sealing means provided with a sealing roller 11, a sealing roller motor 12, a sealing liquid bath 13, etc., and a drying means provided with a blast duct 15, a blower 16, etc.

The feed drum 2 is disposed at the capsule discharge port of the hopper 1 for accommodating filled capsules. The feed drum 2 is configured so that the filled capsules randomly accommodated in the hopper 1 can be held sequentially in an unoriented state.

The filled capsules held in the feed drum 2 are sequentially fed to the capsule orienting means comprising the rectifier roller 3, the transfer roller 5, etc., and the filled capsules are arranged in the same direction. Hence, at the lower portion of the transfer roller 5 serving as the last stage of the capsule orienting means, the postures of the filled capsules are arranged in the same direction. In other words, at the delivery position from the transfer roller 5 to the transfer means, all the filled capsules are transferred while their bodies and caps are disposed in the same direction.

In the transfer means to which the filled capsules have been delivered, the filled capsules are transferred in the horizontal direction by the slats 7 being connected endlessly. The bottom plate 8 is provided below the slats 7 to support, from below, the filled capsules being transferred.

In the transfer means, the sealing means is provided on the downstream side from the position wherein the filled capsules are delivered. In the sealing means, the sealing roller 11, the lower portion of which is dipped in a sealing liquid inside the sealing liquid bath 13, makes contact with the connection portion of the cap and body of the filled capsule being transferred. Hence, the sealing liquid attached to the external circumferential face of the sealing roller 11 is applied to the connection portion of the filled capsule, and a band seal is formed.

In the conventional capsule sealing apparatus, the drying means is provided on the downstream side from the installation position of the sealing means. The drying means comprises the blast duct 15 provided on the lower face of the bottom plate 8 and the blower 16 for feeding air into the blast duct 15. The bottom plate 8 is provided with a plurality of air ports through which air is discharged to the filled capsules moving above the bottom plate 8 to dry the filled capsules.

After the band seal is formed at the connection portion of the filled capsule as described above, the filled capsule is transferred to the drying means and forcibly dried in the blast duct 15 by the air discharged from the blower 16.

Since the filled capsules filled with the filling material are fed randomly as described above, the conventional capsule sealing apparatus is provided with the capsule orienting means for orienting the filled capsules in one direction. As a result, the conventional capsule sealing apparatus has a problem of being large in the size of the apparatus. In addition, filling processing for filling empty capsules with the filling material is carried out by a capsule filling apparatus as preprocessing being carried out before capsule sealing. Then, the filled capsules having been subjected to the filling processing are transferred to the above-mentioned capsule sealing apparatus serving as another production line, and then the sealing processing is carried out. Hence, in the case of a liquid filling material in particular, there is a danger of leakage while the filled capsules not yet sealed are stored or transferred between the production lines, thereby lowering productivity.

By solving the above-mentioned problems, the present invention is intended to provide a compact capsule filling-sealing apparatus capable of sequentially carrying out sealing processing after filling processing on the same production line without requiring unnecessary storage and transfer after the filling processing for capsules.

DISCLOSURE OF THE INVENTION

In order to accomplish the above-mentioned object, a capsule filling-sealing apparatus in accordance with the present invention comprises:

a capsule filling section, having a turntable holding empty capsules and rotating intermittently at intervals of a constant rotation angle, configured to sequentially carry out a separation process for separating the body and the cap of the empty capsule at the stop position of the intermittent rotation of the above-mentioned turntable, a filling process for filling the above-mentioned body with a filling material, a connection process for connecting the above-mentioned body with the above-mentioned cap to form each of filled capsules, and a transfer process for discharging the filled capsules to the next process, a capsule transfer section for sequentially receiving and holding the filled capsules from the above-mentioned capsule filling section and for transferring the filled capsules while controlling the filled capsules in a desired posture, and a capsule sealing section having a transfer mechanism for receiving the above-mentioned filled capsules from the above-mentioned capsule transfer section and for transferring them in a substantially horizontal direction, and a sealing mechanism for forming a band seal at the connection portion of the cap and the body of the above-mentioned filled capsule to form each of sealed capsules, wherein the above-mentioned capsule filling section, the above-mentioned capsule transfer section and the above-mentioned capsule sealing section are configured substantially integrally so that the production from empty capsules to completed capsules is carried out on the same production line. Hence, a filling unit in which various mechanisms for carrying out filling processing for the empty capsules are functionally disposed, a transfer unit for transferring the filled capsules from the filling unit to a sealing unit, and the sealing unit for securely sealing the filled capsules are disposed organically, whereby a capsule filling-sealing apparatus being compact, highly productive and capable of carrying out sealing processing securely and highly accurately is provided.

The capsule filling section may be configured in which the empty capsule is separated into a body and a cap, the above-mentioned cap is held in a cap holding disc, the body is held in a body holding disc, and the above-mentioned cap holding disc and the above-mentioned body holding disc rotate intermittently together with the turntable at intervals of a constant rotation angle, and in the filling operation for filling the above-mentioned body with the filling material, the above-mentioned body held in the above-mentioned body holding disc is raised, and the tip of a nozzle for discharging the filling material is disposed inside the body.

In addition, the capsule transfer section may comprise a discharge roller for sequentially receiving the filled capsules from the capsule filling section and for holding them, a connection chute having passages for discharging the above-mentioned filled capsules from the above-mentioned discharge roller and for transferring them using compressed air, and a transfer roller for receiving the filled capsules from the above-mentioned connection chute and for controlling the filled capsules in a desired posture.

Furthermore, the discharge roller of the capsule transfer section may be configured to receive a plurality of filled capsules and defective capsules held in the cap holding disc and to hold them by suction while rotating intermittently, to discharge the filled capsules to the capsule discharge port of the connection chute disposed at a predetermined position in the vicinity of the external circumferential face of the above-mentioned discharge roller, and to feed the defective capsules to a defective capsule discharge port disposed in the vicinity of the external circumferential face of the above-mentioned discharge roller at a position different from the above-mentioned capsule discharge port and to eject the defective capsules outside the production line.

Still further, the capsule transfer section may be configured in which capsule holding holes are formed on the external circumferential face of the transfer roller, the above-mentioned capsule holding holes are disposed at the position corresponding to the capsule discharge port of the connection chute by virtue of the rotation of the above-mentioned transfer roller, each of the above-mentioned capsule holding holes comprises a horizontal hole being substantially parallel to the center axis of the above-mentioned transfer roller and a vertical hole extending substantially vertically to the above-mentioned center axis at one end of the bottom face of the horizontal hole, the above-mentioned vertical hole has a depth smaller than the longitudinal axial length of the filled capsule, and the filled capsules discharged from the above-mentioned capsule discharge port and accommodated in the above-mentioned vertical holes are guided by a guide plate disposed in the vicinity of the external circumferential face of the above-mentioned transfer roller and accommodated in the above-mentioned horizontal holes.

Still further, the transfer mechanism of the capsule sealing section may be configured to comprise slats for guiding the filled capsules so as to be movable freely and bottom plates, disposed in the vicinity of the lower faces of the above-mentioned slats, for supporting the filled capsules, in which each of the filled capsules received from the transfer roller makes contact with the above-mentioned bottom plate and rotates on its axis during transfer, and the direction perpendicular to the rotation axis of the rotation on its axis is different from the transfer direction, whereby the filled capsule is moved in one direction and positioned.

Still further, the capsule sealing section may be configured to comprise two sealing mechanisms disposed on the same transfer line, in which a first sealing mechanism applies a sealing liquid to the connection portion of the cap and the body of the filled capsule, and a second sealing mechanism pushes the above-mentioned connection portion in a way adapted for its shape to form a band seal.

Still further, the capsule sealing section may be configured in which the first sealing mechanism has a first sealing roller having an external circumferential face partially dipped in the sealing liquid and making contact with the connection portion of the filled capsule, the second sealing mechanism has a second sealing roller having an external circumferential face partially dipped in the sealing liquid and making contact with the above-mentioned connection portion, the cross-sectional shape of the external circumferential face of the above-mentioned first sealing roller in a direction parallel to the rotation axis thereof has a concave shape, and the cross-sectional shape of the external circumferential face of the above-mentioned second sealing roller in a direction parallel to the rotation axis thereof is a step shape adapted for the shape of the above-mentioned connection portion.

Still further, a sensor section for inspecting the external appearances of the sealed capsules may be disposed at the latter stage of the capsule sealing section and may be configured to comprise a sensor roller for forcibly rotating the sealed capsules located at the inspection position at a desired rotation speed from the lower face of the transfer mechanism and a line sensor camera for inspecting the sealing states of the connection portions of the sealed capsules at the detection position to detect defective band seals.

Still further, the capsule filling-sealing apparatus in accordance with the present invention may be configured to further comprise a capsule drying section for receiving the sealed capsules from the capsule sealing section and for drying the band seals of the connection portions.

Still further, the capsule drying section may be configured to comprise an endless capsule transfer mechanism disposed so as to meander vertically while holding the sealed capsules and a blower for blowing air from above and/or sides to the above-mentioned capsule transfer mechanism, in which the above-mentioned capsule transfer mechanism receives the sealed capsules, moves them by a predetermined distance to dry them, and discharges the sealed capsules as completed capsules.

Still further, the capsule transfer section may be configured to comprise a cylindrical cooling section for sequentially receiving the filled capsules from the capsule filling section and stacking and holding them, a capsule holding block configured to receive the filled capsules from the above-mentioned cooling section, to hold them and to be capable of moving them by a predetermined distance, a transfer section for receiving the filled capsules from the above-mentioned capsule holding block and for discharging the capsules in a desired sequence, and a transfer roller for transferring the filled capsules received sequentially from the above-mentioned transfer section to a transfer mechanism in the later stage while controlling the postures of the filled capsules.

Still further, an opening communicating with outside air may be provided in the vicinity of the capsule discharge port in the connection chute of the capsule transfer section, and the above-mentioned opening may be configured to discharge the air flow for capsule transfer, flowing inside the above-mentioned connection chute, to outside air.

Still further, a crack prevention guide may be provided at the portion of delivering the filled capsules from the connection chute to the transfer roller of the capsule transfer section so that the vicinity of the capsule discharge port of the connection chute is communicated with a vacuum passage provided in the above-mentioned transfer roller.

While the novel features of the invention are set forth particularly in the appended claims, the invention, both as to configuration and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

BEST MODES FOR CARRYING OUT THE INVENTION

Embodiment 1 serving as a preferred embodiment of a capsule filling-sealing apparatus in accordance with the present invention will be described in detail below referring to the accompanying drawings.

EMBODIMENT 1

Figure 1:
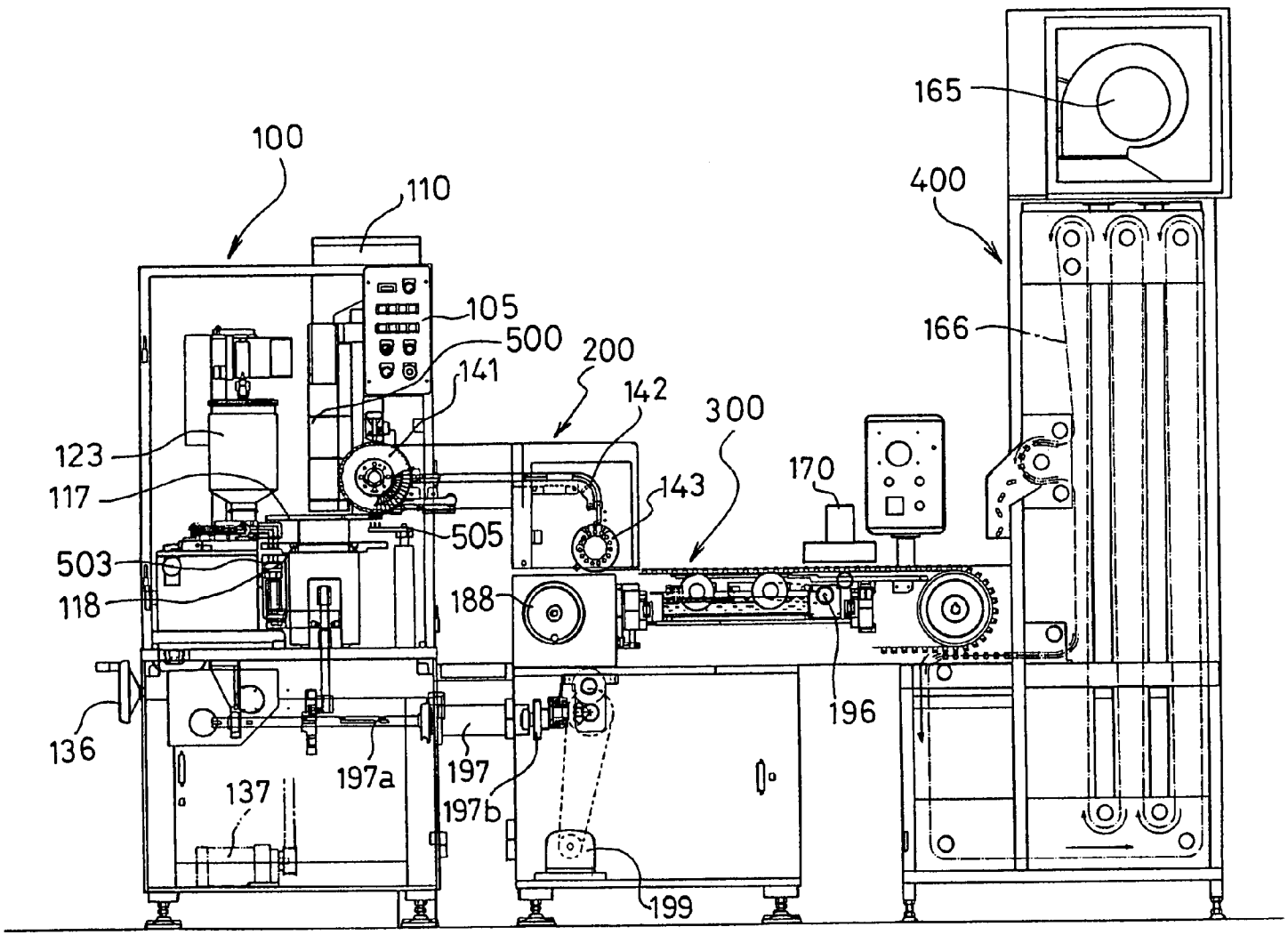
FIG. 1 is a side view showing the entire configuration of a capsule filling-sealing apparatus in accordance with Embodiment 1 of the present invention.
Figure 2:
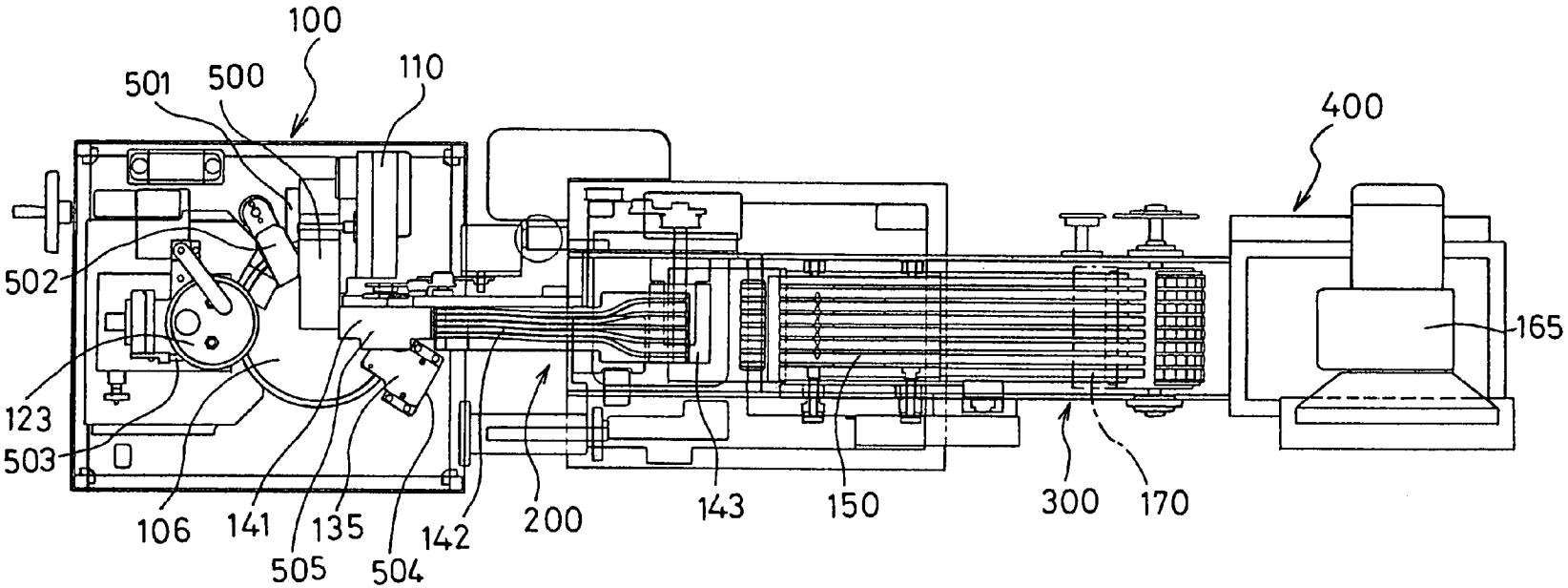
FIG. 2 is a plan view showing the whole of the capsule filling-sealing apparatus in accordance with Embodiment 1 of the present invention.

FIG. 1 is a side view showing the entire configuration of the capsule filling-sealing apparatus in accordance with Embodiment 1 of the present invention. FIG. 2 is a plan view showing the whole of the capsule filling-sealing apparatus in accordance with Embodiment 1. In the capsule filling-sealing apparatus in accordance with Embodiment 1, some parts of the housing, constituting the external appearances of respective units, are made of a transparent material so that internal operations can be checked at all times. More specifically, they are the side plates of a filling unit and a drying unit, the top plate of a connection unit, etc.

As shown in FIG. 1 and FIG. 2, the capsule filling-sealing apparatus in accordance with Embodiment 1 comprises a filling unit 100 serving as a capsule filling section wherein empty capsules are fed and filled with a filling material to produce filled capsules, a connection unit 200 serving as a capsule transfer section for sequentially transferring the filled capsules in a state of being oriented in one direction, a sealing unit 300 serving as a capsule sealing section for sealing the filled capsules, and a drying unit 400 serving as a capsule drying section for drying the sealed capsules. The empty capsule is herein defined as a hard capsule not yet filled with any filling material, its cap and body being in a state of being loosely fitted with each other (in a temporary connection state). The filled capsule is defined as a capsule wherein its body is filled with a predetermined amount of a filling material, such as a medicine in the form of powder or liquid, or a food product in the same form, and the body and the cap are completely fitted to each other in a locked state. In addition, the sealed capsule is defined as a capsule obtained by applying a sealing liquid to the connection portion of the cap and the body of the filled capsule and by drying the sealing liquid to form a band seal.

Each of the filling unit 100, the connection unit 200, the sealing unit 300 and the drying unit 400 of the capsule filling-sealing apparatus in accordance with Embodiment 1 of the present invention will be described below.

[Filling Unit 100]

Figure 3:
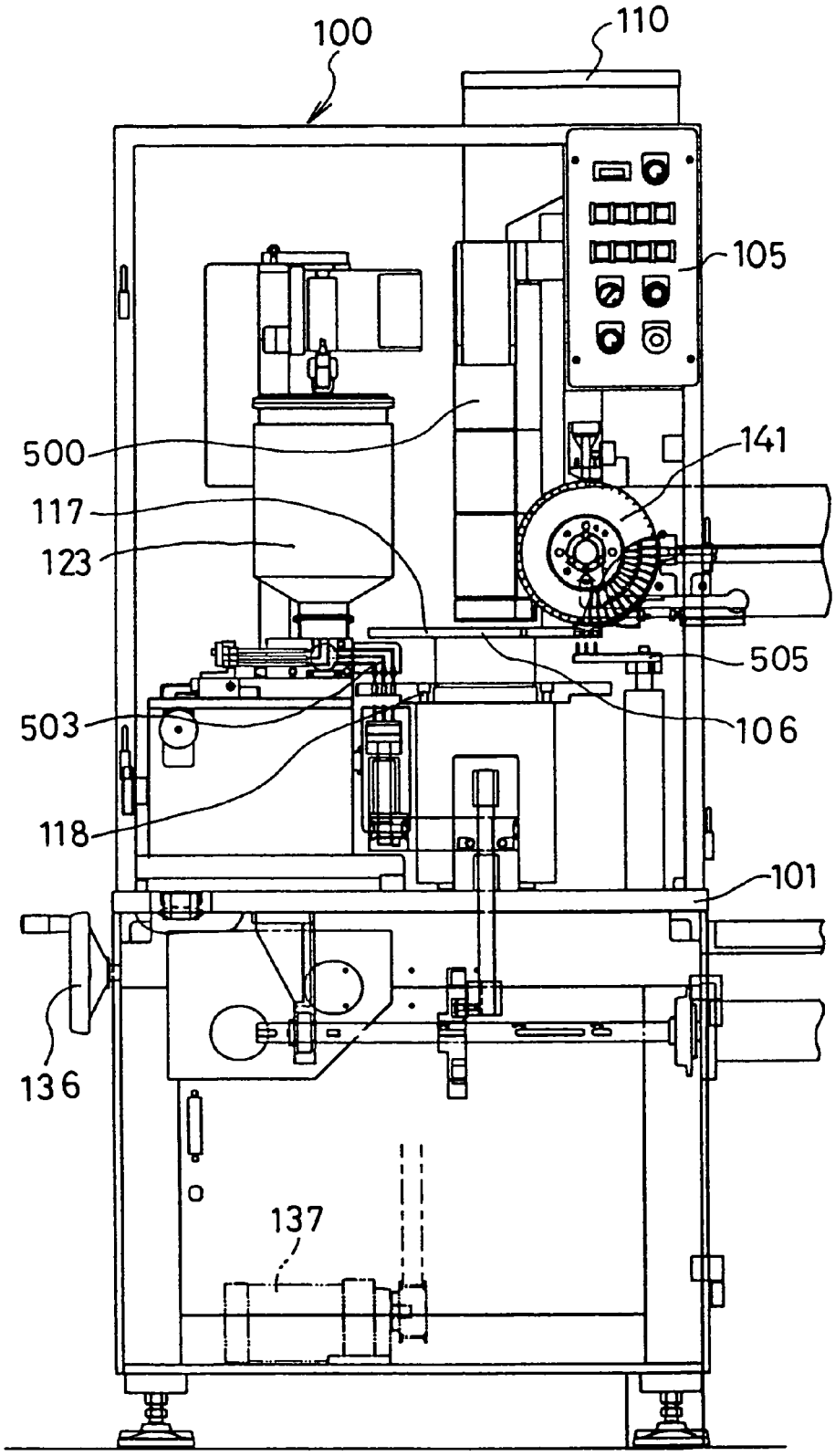
FIG. 3 is a side view showing a filling unit 100 in the capsule filling-sealing apparatus in accordance with Embodiment 1.
Figure 4:
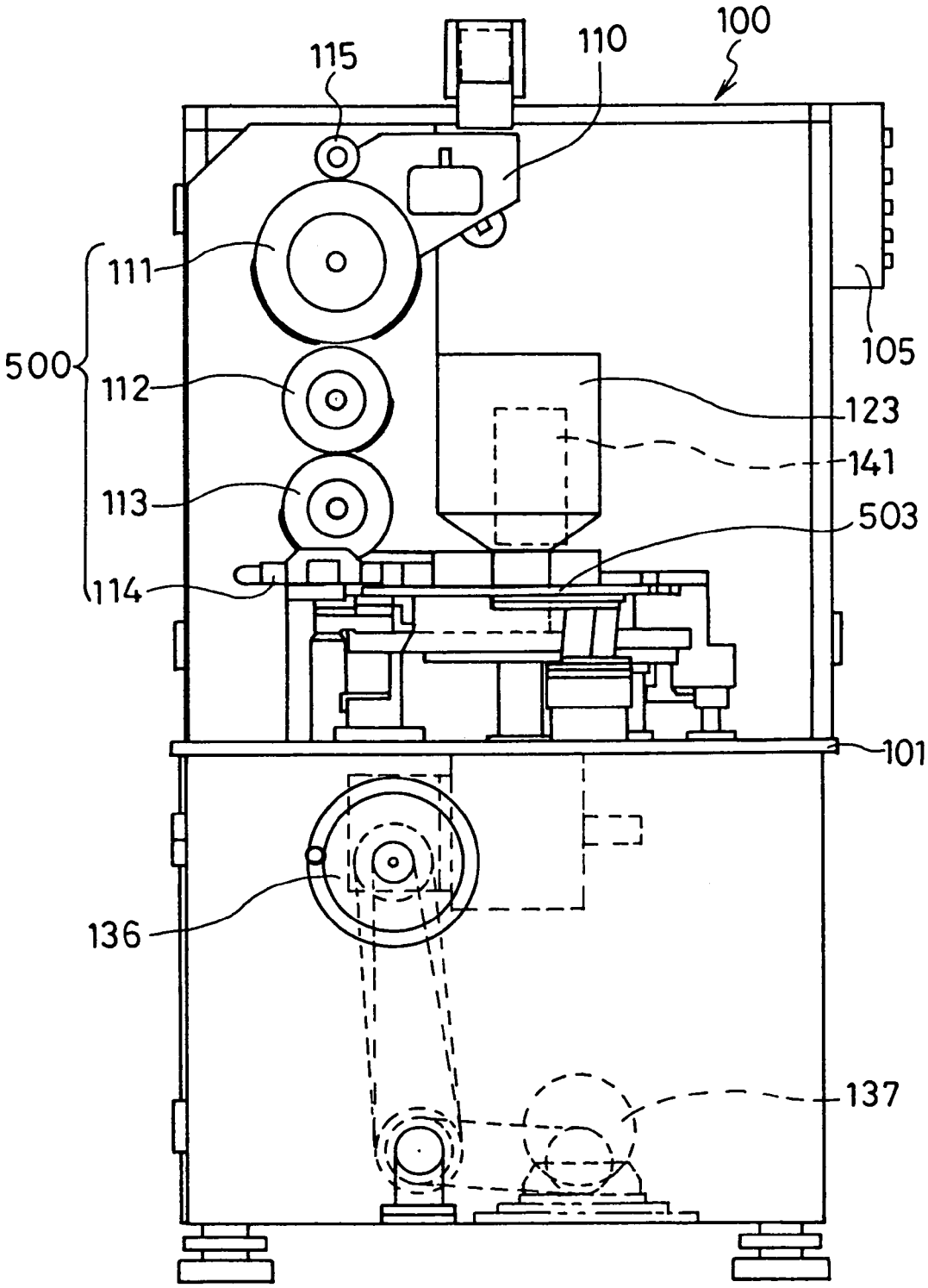
FIG. 4 is a front view showing the filling unit 100 in the capsule filling-sealing apparatus in accordance with Embodiment 1.
Figure 5:
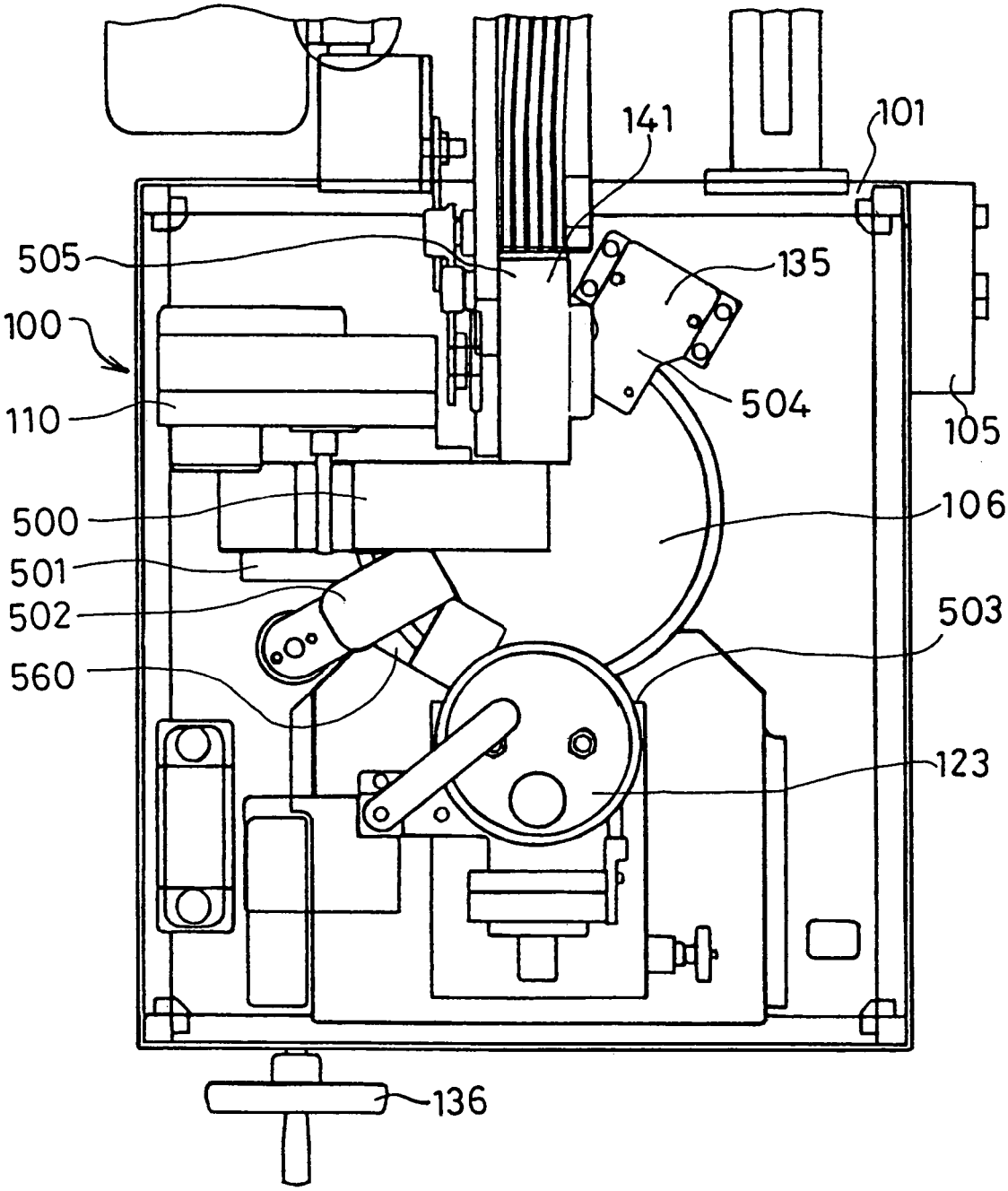
FIG. 5 is a plan view showing the filling unit 100 in the capsule filling-sealing apparatus in accordance with Embodiment 1.

FIG. 3 and FIG. 4 are a side view and a front view showing the filling unit 100 of the capsule filling-sealing apparatus in accordance with Embodiment 1. FIG. 5 is a plan view of the filling unit 100.

The filling unit 100 of the capsule filling-sealing apparatus in accordance with Embodiment 1 is provided with a capsule orienting mechanism 500, a capsule loading-separating mechanism 501, a capsule separation defect elimination mechanism 502, a filling material feeding mechanism 503, a capsule connection mechanism 504, a capsule transfer mechanism 505 and a cleaning mechanism on a base 101. The capsule orienting mechanism 500 controls the posture of empty capsules fed from an empty capsule hopper 110 in a constant direction. The capsule loading-separating mechanism 501 separates the empty capsule into a cap and a body. The capsule separation defect elimination mechanism 502 detects and eliminates defective capsules not being separated into a body and a cap. The filling material feeding mechanism 503 has a filling material hopper 123 accommodating a filling material and feeds the filling material to the body of each empty capsule. The capsule connection mechanism 504 connects the body accommodating the filling material with the cap. The capsule transfer mechanism 505 transfers the filled capsules to the connection unit 200. In addition, the cleaning mechanism cleans a turntable that sequentially feeds the capsules to respective mechanisms. The above-mentioned respective mechanisms will be detailed later. The respective mechanisms are controlled by a filling unit operation panel 105 disposed on the external face of the housing. Furthermore, below the base 101 and on the external face of the housing, a handle 136 for manually driving the filling material feeding mechanism 503 of the filling unit 100 is provided in a protruding state. A turntable 106 described later, the capsule orienting mechanism 500, the filling material feeding mechanism 503, etc. can be driven by the operation of this handle 136, instead of a main motor, whereby the cleaning operation for the filling unit 100 and other operations are made easy. Moreover, a main motor 137 for driving the respective mechanisms of the filling unit 100 and other units is provided inside the housing below the base 101.

The filling unit 100 is provided with the turntable 106, rotating around a vertical shaft intermittently at intervals of a constant rotation angle, for holding and transferring the capsules. Around the circumference of this turntable 106, component devices, such as the capsule orienting mechanism 500, the capsule loading-separating mechanism 501, the capsule separation defect elimination mechanism 502, the filling material feeding mechanism 503, the capsule connection mechanism 504, the capsule transfer mechanism 505 and the cleaning mechanism, are disposed. These component devices are configured to operate while being mutually related to the respective mechanisms inside the filling unit 100 by intermittent rotation of the turntable 106 to fill the empty capsules, having been fed, with the filling material and to deliver the filled capsules to the connection unit 200 disposed at the subsequent stage. Furthermore, at the stop position of the intermittent rotation of the turntable 106 for holding the capsules, processing for the capsules is carried out by the above-mentioned respective mechanisms.

Figure 6:
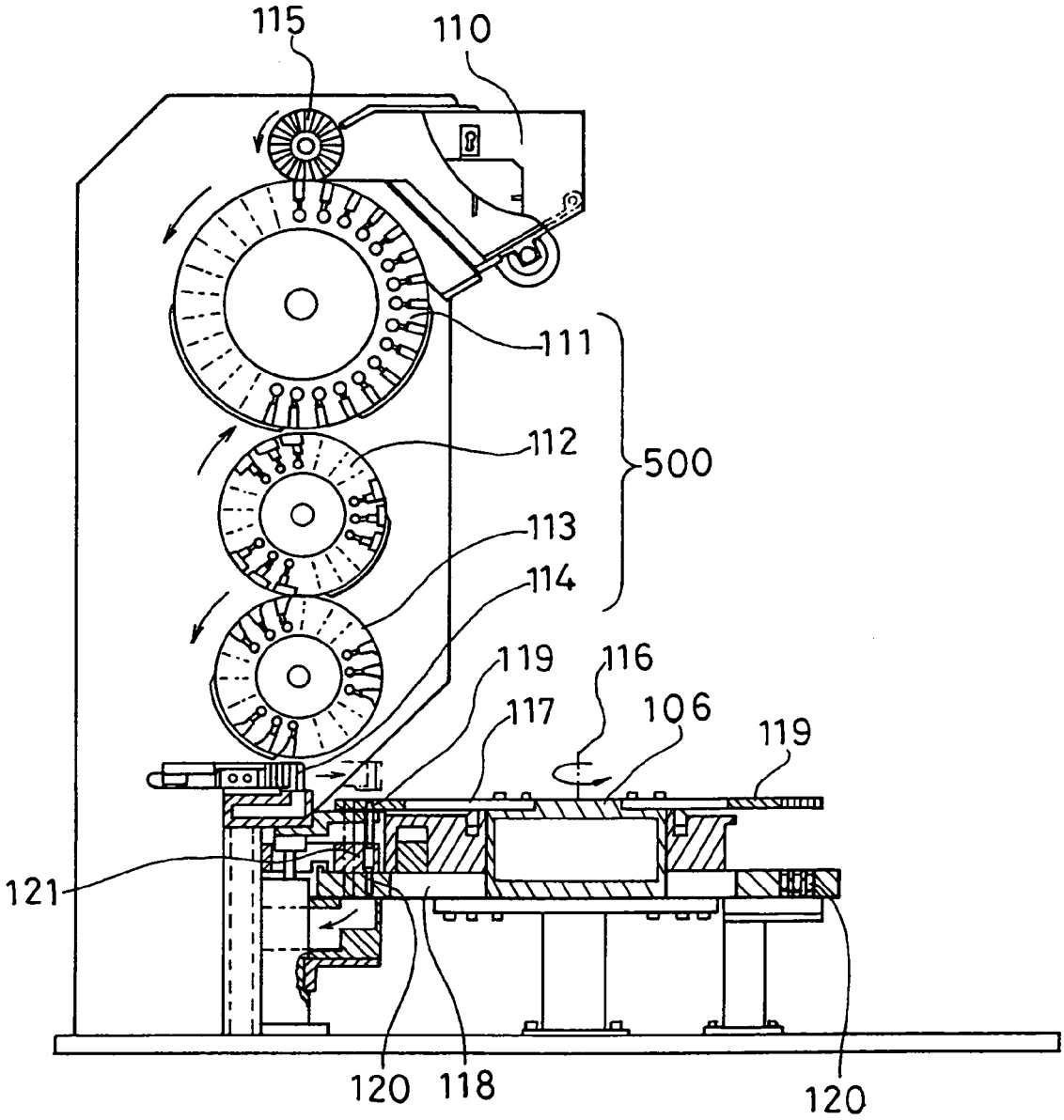
FIG. 6 is a front view showing the internal configuration of a capsule orienting mechanism 500 in the filling unit 100 in the capsule filling-sealing apparatus in accordance with Embodiment 1.

FIG. 6 is a front view showing the internal configuration of the capsule orienting mechanism 500 in the filling unit 100. As shown in FIG. 6, the capsule orienting mechanism 500 comprises a feed drum 111, part of the circumferential face of which makes contact with the lower feed port of the empty capsule hopper 110, an orienting roller 112 disposed so as to be opposed to the lower side of this feed drum 111, a reverse rotation drum 113 similarly disposed so as to be opposed to the lower side of this orienting roller 112, and a capsule feeding section 114 disposed so as to be opposed to the lower side of the reverse rotation drum 113.

Inside the empty capsule hopper 110, numerous empty capsules are accommodated at random in a state wherein the cap and the body are loosely connected, that is, in a temporary connection state. The capsule orienting mechanism 500 arranges all the empty capsules fed from the empty capsule hopper 110 in an upright posture, and sequentially delivers the capsules by using the capsule feeding section 114 disposed at the lowermost position to a filling process via a capsule loading-separating process, etc. at the next stage. A brush roller 115 is disposed so as to be rotatable and opposed to the uppermost portion of the feed drum 111. The capsule orienting mechanism 500 configured as described above has been disclosed in detail as a capsule orienting device, for example, in the Official Gazette of Japanese Unexamined Patent Publication No. Sho 61-211213 applied by the applicant of the present invention, and the mechanism itself has already been known; therefore, the detailed descriptions of the specific operation states of the above-mentioned respective members and mechanisms are omitted.

The filling unit 100 in accordance with Embodiment 1 of the present invention is not limited to the above-mentioned filling method, but any other capsule orienting means can be used as desired.

In FIG. 6, the turntable 106 comprises a vertical shaft 116, and a cap holding disc 117 and a body holding disc 118, a pair of disc-shaped rotation members disposed so as to be parallel and opposed to each other vertically with a constant distance therebetween. A predetermined number of cap-accommodating pockets 119 for holding the caps of the empty capsules are formed regularly at predetermined intervals in the cap holding disc 117 disposed at the upper portion of the vertical shaft 116. In Embodiment 1, the cap-accommodating pockets 119 of the cap holding disc 117 are formed in 12 groups, each group having 3 lines×5 rows=15 pieces, whereby 180 pieces are formed.

On the other hand, in the body holding disc 118 disposed below the cap holding disc 117 so as to be opposed thereto, body accommodating pockets 120, as many as the cap accommodating pockets 119, are formed regularly at the positions corresponding to those of the cap accommodating pockets 119 of the cap holding disc 117.

The empty capsules being in the upright posture and in the temporary connection state and delivered from the capsule feeding section 114 at the last stage of the capsule orienting mechanism 500 are first held in the same posture by the cap holding disc 117. Next, the capsules are each separated into the body and the cap in preparation for the filling processing for filling the capsules with the filling material (the capsule loading-separating process).

Figure 7:
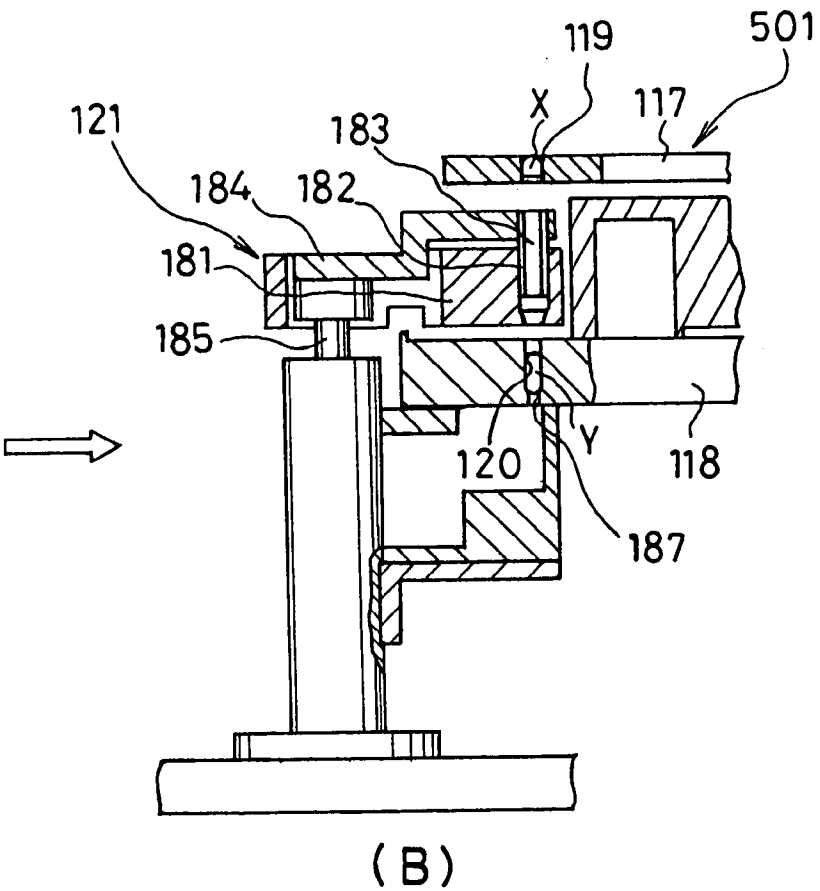
FIG. 7 is a side cross-sectional view showing the operation of a capsule guide mechanism 121 in a capsule loading-separating process.
Figure 7:
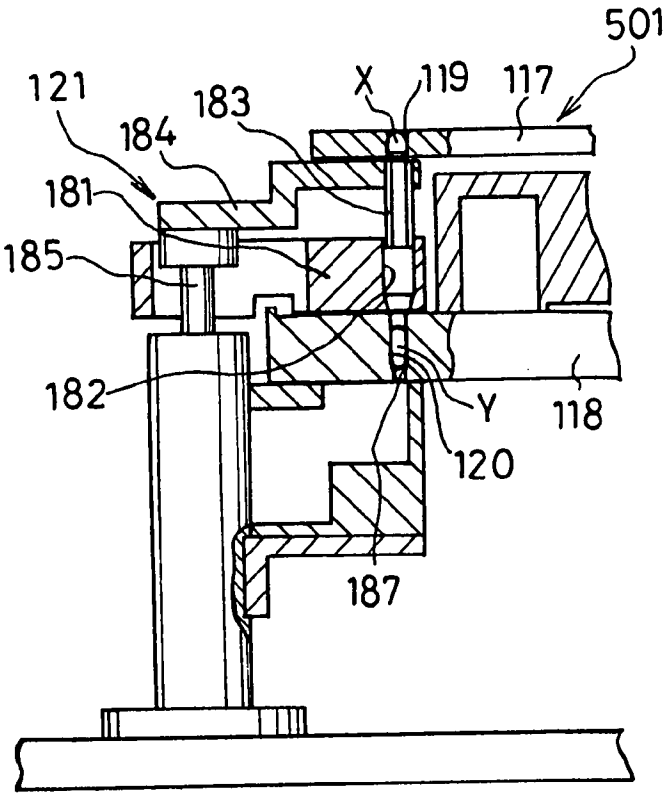

The filling unit 100 in accordance with Embodiment 1 is provided with a capsule guide mechanism 121 between the cap holding disc 117 and the body holding disc 118 disposed in parallel to each other with a predetermined distance therebetween. The capsule guide mechanism 121 has a function of communicating the cap accommodating pocket 119 with the body accommodating pocket 120 disposed thereunder and corresponding thereto. FIG. 7 is a side cross-sectional view showing the operation of the capsule guide mechanism 121 in the capsule loading-separating process.

As shown in FIG. 7, the capsule guide mechanism 121 comprises a capsule guide base 181 and a cylindrical member 183, having a through hole through which only the body of the capsule can pass, and one end of which is inserted into a large-diameter pocket hole 182 formed in this capsule guide base 181 so as to be movable vertically. The cylindrical member 183 is secured to a movable board 184 disposed so as to be movable vertically via an arm 185 with respect to the capsule guide base 181.

During the capsule loading-separating process for the bodies and the caps of the empty capsules, as shown in part (A) of FIG. 7, the capsule guide base 181 of the capsule guide mechanism 121 is disposed close to the upper face of the body holding disc 118 with a slight clearance therebetween. In addition, the movable board 184 is disposed so as to nearly make contact with the lower face of the cap holding disc 117 when the arm 185 rises. As a result, the cap accommodating pocket 119 and the body accommodating pocket 120 corresponding thereto, formed in the cap holding disc 117 and the body holding disc 118, respectively, are substantially communicated, and a movement passage only for the body separated from the cap are formed. Hence, in this state, the body is moved downward by suction exerted from below, and only the cap is held in the cap accommodating pocket 119. The body separated from the cap is guided by the cylindrical member 183 of the capsule guide mechanism 121 and completely accommodated inside the corresponding body accommodating pocket 120 disposed downward. In Embodiment 1, an elastic member, for example, an O-ring made of rubber, is disposed as a shock absorber at the lower end of the body accommodating pocket 120. Hence, the body separated from the cap by suction makes contact with this elastic member, whereby cracks, scratches, dents, etc. are prevented from occurring at the shoulder portion of the body.

In the case when the cap holding disc 117 and the body holding disc 118 rotate intermittently, immediately before the rotation, the arm 185 of the capsule guide mechanism 121 operates to sufficiently separate the capsule guide mechanism 121 from the cap holding disc 117 and the body holding disc 118 as shown in part (B) of FIG. 7 so that the intermittent rotation of the cap holding disc 117 and the body holding disc 118 are carried out without hindrance.

In Embodiment 1, the capsule separation defect elimination mechanism 502 is provided at the latter stage of the capsule loading-separating mechanism that separates the empty capsules as described above. The capsule separation defect elimination mechanism 502 detects a separation defect wherein the cap of an empty capsule is not completely separated from the body, a reversely oriented capsule defect wherein the positions of the cap and the body are reversed, a defect wherein a plurality of caps are stacked, and other defects, and eliminates such defects. The capsule separation defect elimination mechanism 502 detects the above-mentioned defective capsule by inserting a pin having a predetermined length into the cap accommodating pocket 119 of the cap holding disc 117 from below to a predetermined position, a cap being held in the cap accommodating pocket 119. In other words, in the case when a body and a capsule have been connected in a temporary connection state and held in the cap accommodating pocket 119, the pin makes contact with the body by the upward movement of the pin, and the defective capsule is eliminated from the cap accommodating pocket 119. When the defective capsule is detected as described above, the capsule separation defect elimination mechanism 502 ejects the defective capsule from the cap holding disc 117 to the outside of the production line. The capsule separation defect elimination mechanism 502 is provided with optical sensors 560 above and below the cap holding disc 117 and the body holding disc 118. These optical sensors 560 carry out detection to judge whether a cap and a body are accommodated in each cap accommodating pocket 119 and each body accommodating pocket 120, respectively, at the final stage of the capsule loading-separating process. When the optical sensors 560 detect that some of the cap accommodating pockets 119 or some of the body accommodating pockets 120 are empty, the positions of the empty cap accommodating pockets 119 or the empty body accommodating pockets 120 are memorized. By this memorization of the positions of the cap accommodating pockets 119 or the body accommodating pockets 120 holding no capsules, the filling processing is not carried out for the corresponding body accommodating pockets 120 at the latter stage of the filling process. Furthermore, the caps or the bodies of the defective capsules for which the filling processing was not carried out are ejected to the outside of the production line by a discharge roller 141 that is provided at the latter stage of the filling processing and described later.

Figure 8:
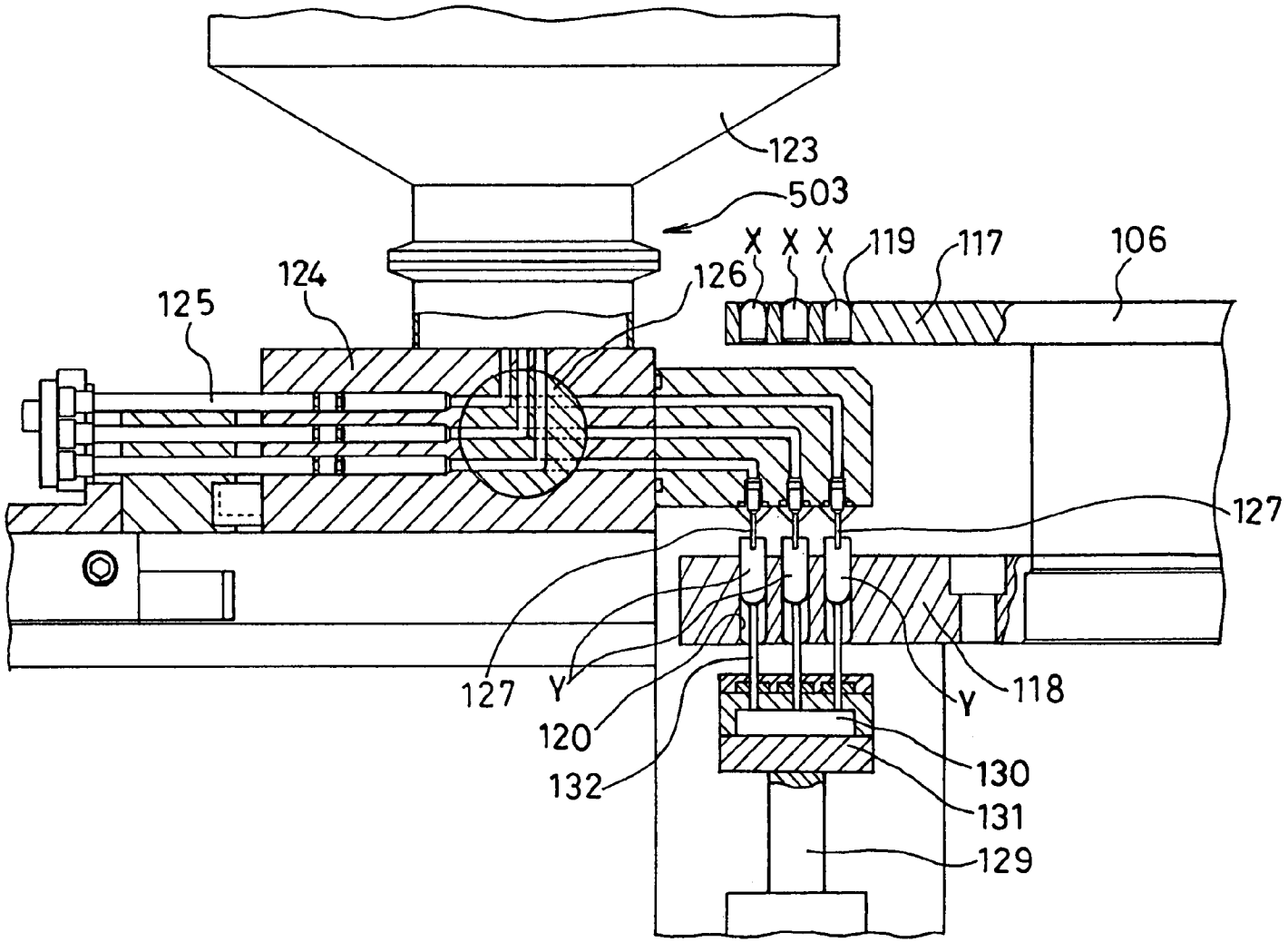
FIG. 8 is a view showing the configuration of a filling material feeding mechanism 503 in the filling unit 100 in the capsule filling-sealing apparatus in accordance with Embodiment 1.

FIG. 8 is a view showing the configuration of the filling material feeding mechanism 503 in the filling process for feeding a liquid filling material in the filling unit 100, partially shown in cross section. The filling material feeding mechanism 503 is provided in the vicinity of the body holding disc 118 and on the downstream side of the turntable 106 in its rotation direction from the installation position of the capsule separation defect elimination mechanism 502. The filling material feeding mechanism 503 comprises the filling material hopper 123, a flow passage change unit 124, a measuring unit 125, a flow passage selection block 126, nozzles 127, etc., these being disposed below the filling material hopper 123. As shown in FIG. 8, a desired amount of the filling material inside the filling material hopper 123 is guided once to the measuring unit 125 via the flow passage set by the flow passage selection block 126 by the piston operation of the measuring unit 125. Then, by the movement of the flow passage selection block 126 in a direction perpendicular to the paper face of FIG. 8, a flow passage from the measuring unit 125 to the nozzle 127 is formed. At this time, the body (Y) held in the body accommodating pocket 120 of the body holding disc 118 is raised, and the opening end of the body (Y) is positioned higher than the tip of the nozzle 127. In this state, the predetermined amount of the filling material held in the measuring unit 125 is poured into the body (Y) through the flow passage having been formed.

In Embodiment 1, the body (Y) held in the body accommodating pocket 120 of the body holding disc 118 is supported by the tip of a pin 132 having a through hole communicating with a vacuum passage 130, and a suction block 131 having the vacuum passage 130 is moved vertically by a predetermined distance by a rod 129 driven with a cam inside the main body. Therefore, in the above-mentioned filling operation, by virtue of the raising operation of the rod 129, the body (Y) inside the body accommodating pocket 120 is pushed up by the tip of the pin 132. Hence, the opening end of the body (Y) is disposed so as to be positioned higher than the tip of the nozzle 127, and the tip of the above-mentioned nozzle 127 is disposed inside the body. As a result, the liquid filling material serving as the filling material in the above-mentioned filling operation is securely poured into the body (Y), and splashing of the liquid filling material is securely prevented during the filling operation.

When the filling operation for pouring the filling material into the body (Y) of the capsule is completed as described above, the cap (X) and the body (Y) of the capsule are fed by the intermittent operation of the turntable 106 to the capsule connection mechanism 504 of the next stage, and reconnection processing is carried out.

Figure 9:
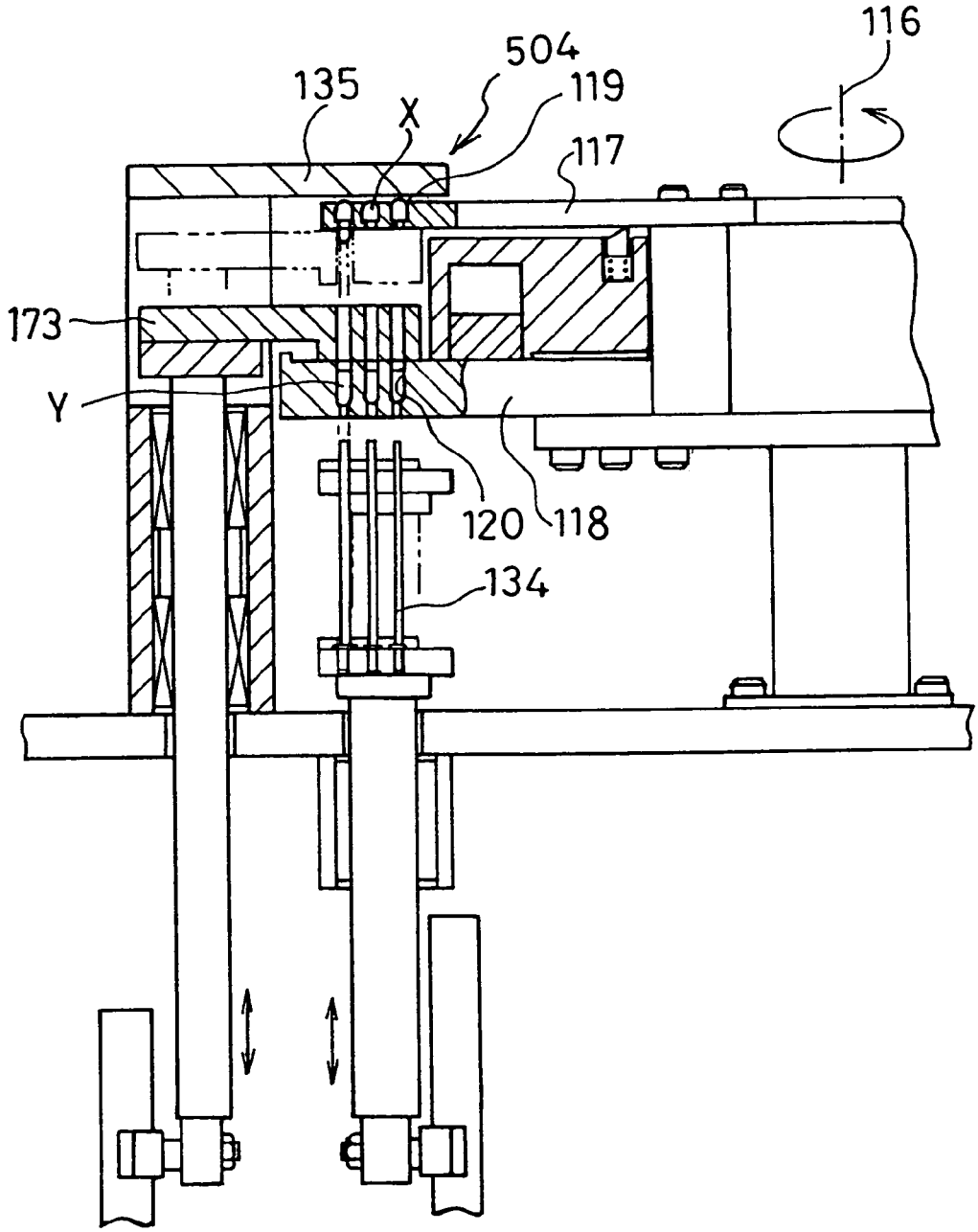
FIG. 9 is a partially cross-sectional view showing a capsule connection mechanism 504 for reconnecting the body filled with the filling material with the cap in the capsule filling-sealing apparatus in accordance with Embodiment 1.

FIG. 9 is a partially cross-sectional view showing the capsule connection mechanism 504 for reconnecting the body (Y) filled with the filling material to the cap (X).

The capsule connection mechanism 504 is installed in the vicinity of the next rotation angle stop position of the filling material feeding mechanism 503 shown in FIG. 8 described above. The capsule connection mechanism 504 comprises a cap push plate 135 disposed in the vicinity of the upper face of the cap holding disc 117 and secured to the main body of the apparatus so as not to move, pushers 134, passing through the body accommodating pockets 120, for pushing the bodies (Y) held in the body accommodating pockets 120 up to the cap holding disc 117, and a capsule guide member 173, being movable vertically, for guiding the bodies (Y) from the body accommodating pockets 120 to the corresponding cap accommodating pockets 119 of the cap holding disc 117 when the bodies (Y) are pushed up by the pushers 134. This capsule guide member 173 has a function similar to that of the capsule guide mechanism 121 having been used in the capsule loading-separating process.

The bodies (Y) holding the filling material are raised from the body accommodating pockets 120 by the pushing-up operation of the pushers 134, and first accommodated inside the capsule guide member 173 disposed directly above. Then, the bodies (Y) being in the same state are raised together with the capsule guide member 173 to a position directly below the cap holding disc 117. Next, the pushers 134 further push up the bodies (Y), and inside the cap accommodating pockets 119, the bodies (Y) are connected to the caps (X), the upper ends of which are pushed by the cap push plate 135.

The filled capsules comprising the bodies (Y) and the caps (X) being connected as described above are fed from the filling unit 100 to the connection unit 200 by the capsule transfer mechanism 505 at the next rotation angle position obtained when the turntable 106 is rotated by a predetermined angle.

In the filling unit 100, a cleaning mechanism is disposed in the vicinity of the next rotation angle position of the installation position of the above-mentioned capsule transfer mechanism 505. The cleaning mechanism is used to clean the surface of the body holding disc 118, the internal faces of the body accommodating pockets 120, the surface of the cap holding disc 117 and the internal faces of the cap accommodating pockets 119 after the filled capsules are ejected to the connection unit 200. This cleaning mechanism is connected to a compressed air generator and a vacuum generator (these are not shown) installed separately from the compressed air generator and the vacuum generator used for the above-mentioned mechanisms in the filling unit 100. At the next rotation angle stop position, the body accommodating pockets 120 and the cap accommodating pockets 119 cleaned by the cleaning mechanism receive new empty capsule arranged in the upright posture from the capsule feeding section 114 of the capsule orienting mechanism 500 and hold the capsules, and the next and subsequent filling operations are carried out repeatedly.

As described above, the above-mentioned respective processes are repeated continuously at every rotation of the body holding disc 118 and the cap holding disc 117, and filled capsules are formed and transferred sequentially to the connection unit 200.

As described above, in the filling unit 100, in accordance with the rotation of the turntable 106 intermittently rotating at intervals of a constant rotation angle around its vertical shaft, the capsule orienting mechanism 500, the capsule loading-separating mechanism 501, the capsule separation defect elimination mechanism 502, the filling material feeding mechanism 503, the capsule connection mechanism 504, the capsule transfer mechanism 505 and the cleaning mechanism operate while being related to one another, whereby the empty capsules fed to the turntable 106 are filled with the filling material, and the filled capsules are delivered continuously to the connection unit 200.

In the above-mentioned filling unit 100, the filling material feeding mechanism in the case when the filling material is in the form of liquid is described; however, in the case when the filling material is in the form of powder or granule, the filling material feeding mechanism should only be changed to a mechanism adapted for the filling material to be used for filling.

In Embodiment 1, in the case when an empty capsule not filled by the filling unit 100 is produced, even if the defective empty capsule is disposed at the position opposed to a capsule intake port 142*a* of a connection chute 142 by the discharge roller 141, the defective empty capsule is not fed to the connection chute 142, but is rotated continuously while being held in the same state in the discharge roller 141. When the defective empty capsule reaches the top portion of the discharge roller 141, it is ejected outside the production line by a defective capsule discharge mechanism 149. In the defective capsule discharge mechanism 149, the defective capsule is discharged outside the system through an ejection pipe by vacuum suction.

[Connection Unit 200]

Figure 10:
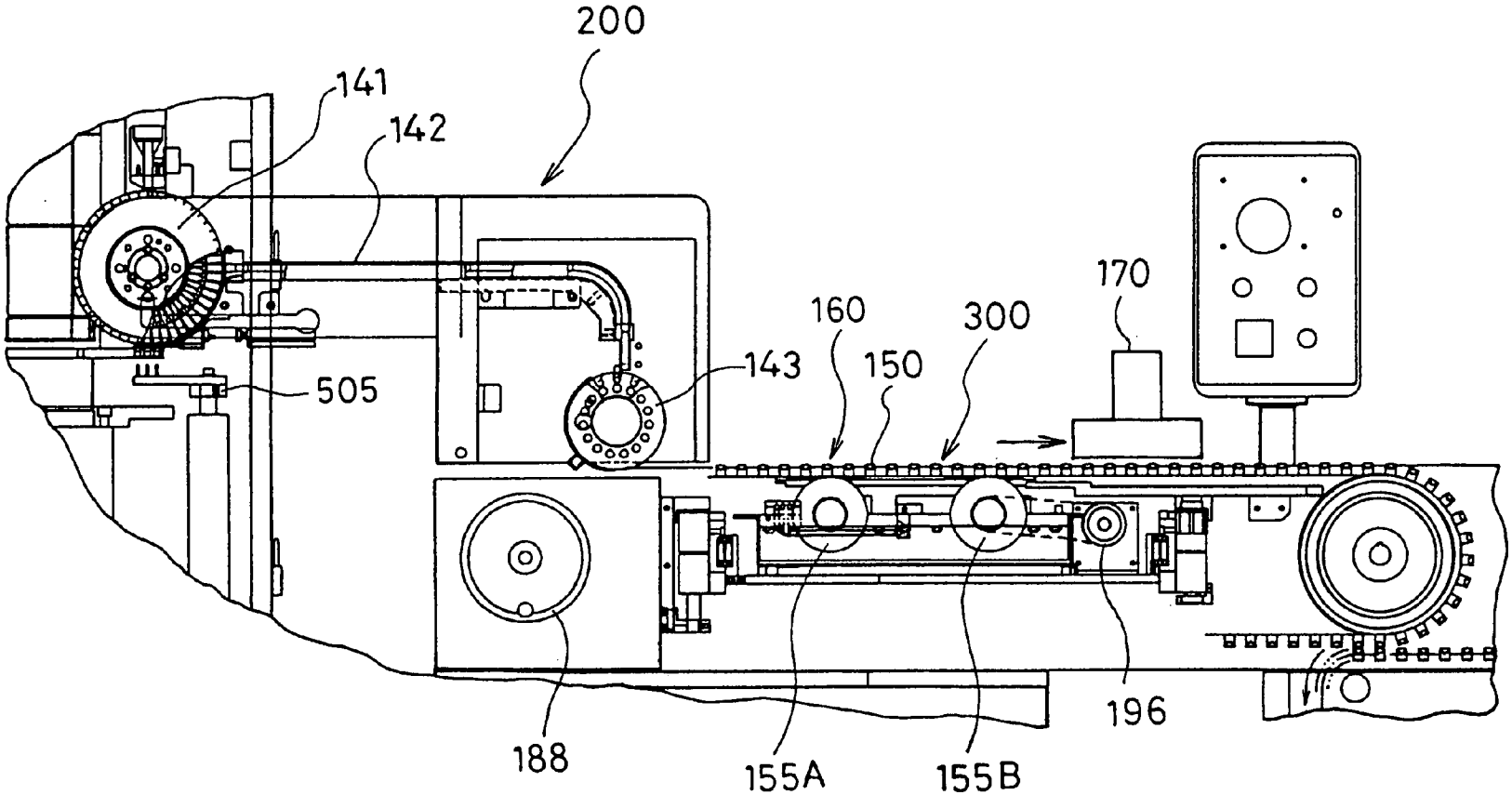
FIG. 10 is a view showing the configuration of a connection unit 200 in the capsule filling-sealing apparatus in accordance with Embodiment 1.
Figure 11:
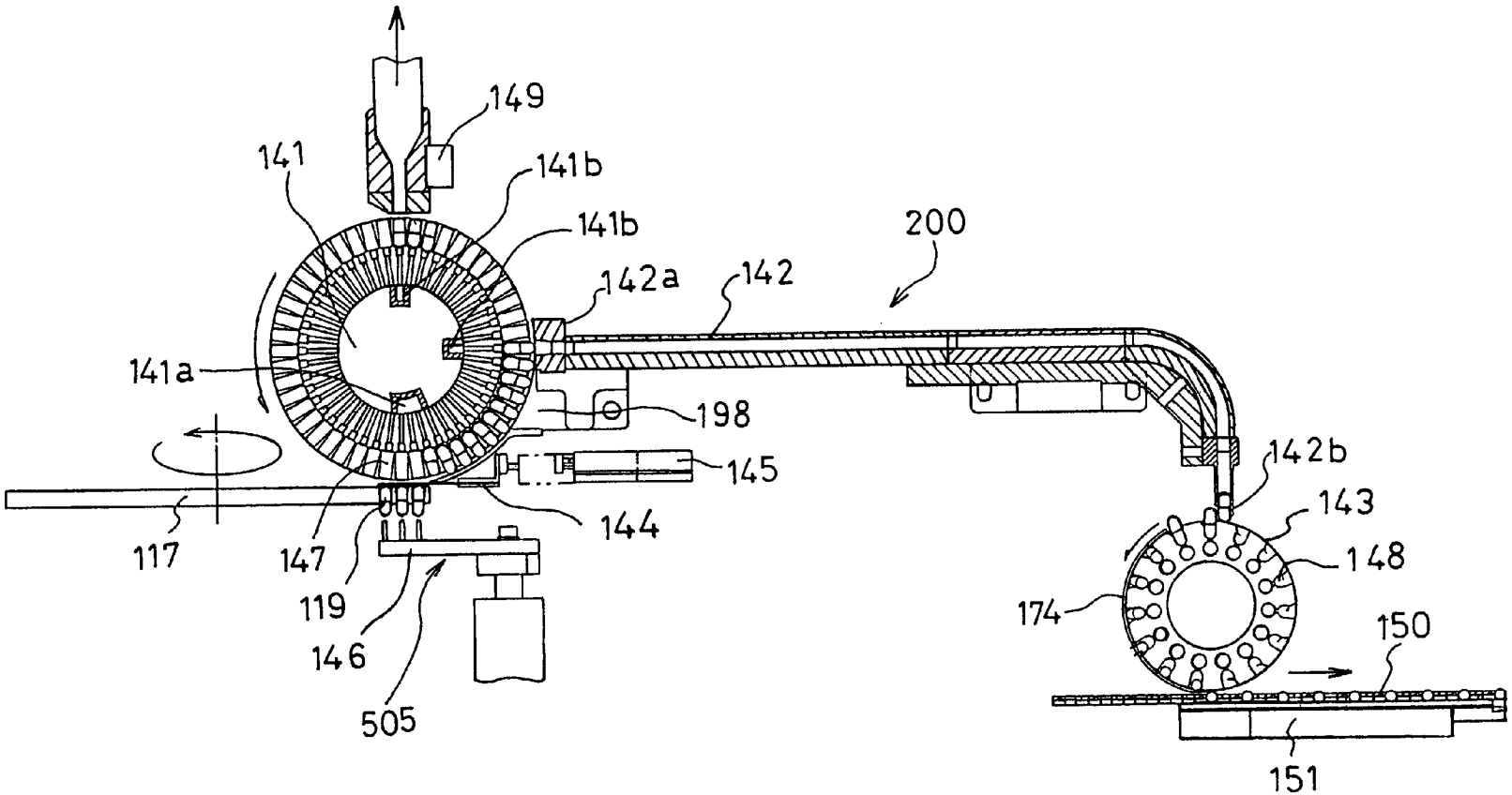
FIG. 11 is a side cross-sectional view showing the internal configuration of the connection unit 200 in the capsule filling-sealing apparatus in accordance with Embodiment 1.

FIG. 10 is a side view showing the configuration of part of the capsule transfer mechanism 505 in the filling unit 100 and the configuration of the connection unit 200 in accordance with Embodiment 1, partially shown in cross section. FIG. 11 is a side cross-sectional view showing the internal configuration of the connection unit 200.

The connection unit 200 comprises the discharge roller 141 having a mechanism for sucking and holding filled capsules, the connection chute 142 for transferring the filled capsules, and a transfer roller 143 for receiving the filled capsules from the connection chute 142 and for feeding them to the sealing unit 300.

As described above, the filled capsules are held in the cap accommodating pockets 119 of the cap holding disc 117 by the capsule connection mechanism 504 and disposed in the capsule transfer mechanism 505 positioned directly below the discharge roller 141 by the intermittent operation of the turntable 106. As shown in FIG. 11, a shutter 144 being reciprocated by an air cylinder 145 is disposed between the discharge roller 141 and the cap accommodating pockets 119. In addition, the capsule transfer mechanism 505 is provided with a discharge pusher 146 capable of pushing up the filled capsules held in the cap accommodating pockets 119 toward the discharge roller 141 from thereunder. Inside the discharge roller 141, a vacuum passage 141*a* for sucking the filled capsules is provided at the position corresponding to the position (the lower position of the discharge roller 141 in Embodiment 1) wherein the filled capsules are discharged from the cap accommodating pockets 119. Furthermore, inside the discharge roller 141, two compressed air passages 141*b* and 141*b* are provided wherein when the capsules being accommodated and held reach predetermined positions (the side position and the upper position of the discharge roller 141 in Embodiment 1), the relevant capsules are ejected.

In the capsule transfer mechanism 505 configured as described above, when the filled capsules held in the cap accommodating pockets 119 of the cap holding disc 117 are disposed directly below the discharge roller 141, the shutter 144 disposed between the discharge roller 141 and the cap accommodating pockets 119 moves, and the lower sides of capsule holding holes 147 are opened. Then, the relevant filled capsules are accommodated inside the capsule holding holes 147 of the discharge roller 141 by the suction force from the discharge roller 141 and the push-up operation of the discharge pusher 146. Since the capsule transfer mechanism 505 is provided with the shutter 144 as described above, when the cap holding disc 117 is in its intermittent operation and has not yet reached the predetermined position, the operation of sucking the filled capsules by the suction force from the discharge roller 141 is prevented. The plurality of capsule holding holes 147 formed radially and having openings on the external circumferential face of the discharge roller 141 have a shape capable of completely accommodating the wholes of the filled capsules.

The filled capsules accommodated inside the capsule holding holes 147 are prevented from dropping from the discharge roller 141 since the openings of the capsule holding holes 147 are closed by a guide 198. By the rotation of the discharge roller 141, the filled capsules are disposed at the position opposed to the capsule intake ports 142*a* of the connection chute 142. The discharge roller 141 carries out intermittent indexing operation, that is, stops each time when each of the capsule holding holes 147 disposed on its circumference reaches the capsule intake port 142*a*. At the position wherein the filled capsules are disposed substantially horizontally, that is, at the position opposed to the capsule intake port 142*a* of the connection chute 142, the discharge roller 141 discharges the relevant filled capsules and moves them inside the connection chute 142 by virtue of the force of the compressed air from the compressed air passage 141*b* of the discharge roller 141, thereby instantaneously transferring them to the transfer roller 143. At this time, it is possible to have a configuration wherein the filled capsules are transferred inside the connection chute 142 by virtue of the suction force due to the vacuum suction from the transfer roller 143 in addition to the force of the compressed air from the discharge roller 141.

The openings of capsule holding holes 148 are formed in the transfer roller 143 so as to pass through at the position opposed to the capsule ejection port 142*b* of the connection chute 142, and the filled capsules having passed through the connection chute 142 are accommodated in the capsule holding holes 148. This capsule holding hole 148 comprises a horizontal hole being parallel to the center axis and being open on the external circumferential face, the bottom face of the horizontal hole being inclined so that the one end of the bottom face is deeper, and a vertical hole extending vertically to the center axis from the lowest portion of this inclined face. The depth of the horizontal hole is slightly larger than the outside diameter of the cap of the filled capsule. The depth of the vertical hole is a depth enough to accommodate the body portion of the filled capsule, and the bottom face of this vertical hole communicates with an air inlet port formed in the axial direction. The delivery of the filled capsules from the connection chute 142 to the transfer roller 143 is carried out by the discharge force of the compressed air from the discharge roller 141 and the weight of each filled capsule.

In addition, the compressed air from the discharge roller 141 is discharged from a vent hole formed in the vicinity of the capsule ejection port 142*b* of the connection chute 142, and the passage of the connection chute 142 is adjusted so as to provide an air flow having a desired pressure.

Furthermore, in Embodiment 1, from the cap accommodating pockets 119 of the cap holding disc 117 to the discharge roller 141, one segment of filled capsules arranged in multiple lines and multiple rows are sucked and held simultaneously, and from the discharge roller 141 to the connection chute 142, the filled capsules are moved one row (for example, one row has five capsules) at a time, thereby being transferred inside the connection chute 142.

As described above, each of the filled capsules fed to the transfer roller 143 is inserted into the vertical hole of the capsule holding hole 148 in the downward upright posture. At this time, the cap of the filled capsule protrudes from the external circumferential face of the transfer roller 143. A guide plate 174 is provided on the external circumferential face of the transfer roller 143 at a position having a predetermined distance from its top portion in its rotation direction. The guide plate 174 has a guide face inclined in the transfer direction of the capsules in each row. When the transfer roller 143 rotates, the caps of the filled capsules, protruding to the inclined guide face of the guide plate 174, are guided and gradually toppled over sideways. Then, the filled capsules are accommodated in the horizontal holes of the capsule holding holes 148. At this time, the body (Y) of the filled capsule is sucked by vacuum, whereby its positional displacement is prevented. As a result, the filled capsules are guided by the guide plate 174 and accommodated in the capsule holding holes 148 while the directions of their bodies and caps are the same, and reach the delivery position to a capsule transfer means provided directly below the transfer roller 143. As described above, at the delivery position from the transfer roller 143 to the capsule transfer means, the directions of the bodies and caps of all the filled capsules are the same.

As described above, in all the capsules fed from the connection chute 142 to the transfer roller 143, the caps and bodies are oriented in the same direction and have the same posture. In other words, in the transfer roller 143, the capsules are received while their bodies are disposed on its internal circumferential side, and their caps are disposed on its external circumferential side. Then, by the cooperative operation of the rotation of the transfer roller 143 and the guidance of the inclined guide face of the guide plate 174, the filled capsules are held in the horizontal holes of the transfer roller 143 in the same direction and disposed at the delivery position.

The filled capsules held in the capsule holding holes 148 of the transfer roller 143 are delivered securely to the capsule transfer means of the sealing unit 300 after the directions of their caps and bodies are all aligned the same.

[Sealing Unit 300]

Next, sealing operation for the filled capsules fed to the sealing unit 300 will be described.

As shown in FIG. 11, the filled capsules fed from the connection chute 142 are received by the capsule holding holes 148 disposed at the top portion of the transfer roller 143, and the filled capsules are delivered to a slat 150 of the sealing unit 300 at the bottom portion of the transfer roller 143. Since the postures of the filled capsules in the connection unit 200 are not changed, the directions of the bodies and caps of all the filled capsules are controlled in the same direction at this time.

The plurality of slats 150 serving as a capsule transfer means installed in the horizontal direction from the position below the transfer roller 143 are connected endlessly and driven in the arrow direction of FIG. 11 by the main motor 137 (FIG. 1) via a transmission mechanism 197. As shown in FIG. 1, the transmission mechanism 197 comprises a drive shaft 197*a*, a clutch mechanism 197*b*, etc. for transmitting driving force from the main motor 137, and carries out driving force transmission between the filling unit 100 and the sealing unit 300. This clutch mechanism 197*b* transmits the driving force from the main motor 137 to the drive mechanisms of the connection unit 200 and the sealing unit 300 during ordinary operation. Hence, during ordinary operation, the drive mechanisms of the filling unit 100, the connection unit 200 and the sealing unit 300 are driven by the main motor 137.

If trouble occurs in the filling unit 100, the above-mentioned clutch mechanism 197*b* shuts off the driving force from the main motor 137, and the drive mechanisms of the connection unit 200 and the sealing unit 300 are driven by an auxiliary motor 199 (FIG. 1) provided inside the sealing unit 300. As described above, even if the drive mechanism of the filling unit 100 stops, sealing processing can be carried out for the filled capsules having been delivered at that time.

In the sealing unit 300, bottom plates 151 are provided directly below the slats 150 on the upper horizontal transfer side of the capsule transfer means. Each slat 150 has the same width as that of the transfer roller 143, and capsule insertion holes 152 are formed at the positions corresponding to the capsule holding holes 148 of the transfer roller 143, the capsule holding holes 148 being arranged in the axial direction. In the sealing unit 300, a handle 188 (FIG. 1) is provided to manually drive the capsule transfer means, thereby facilitating cleaning and other operations.

Figure 12:
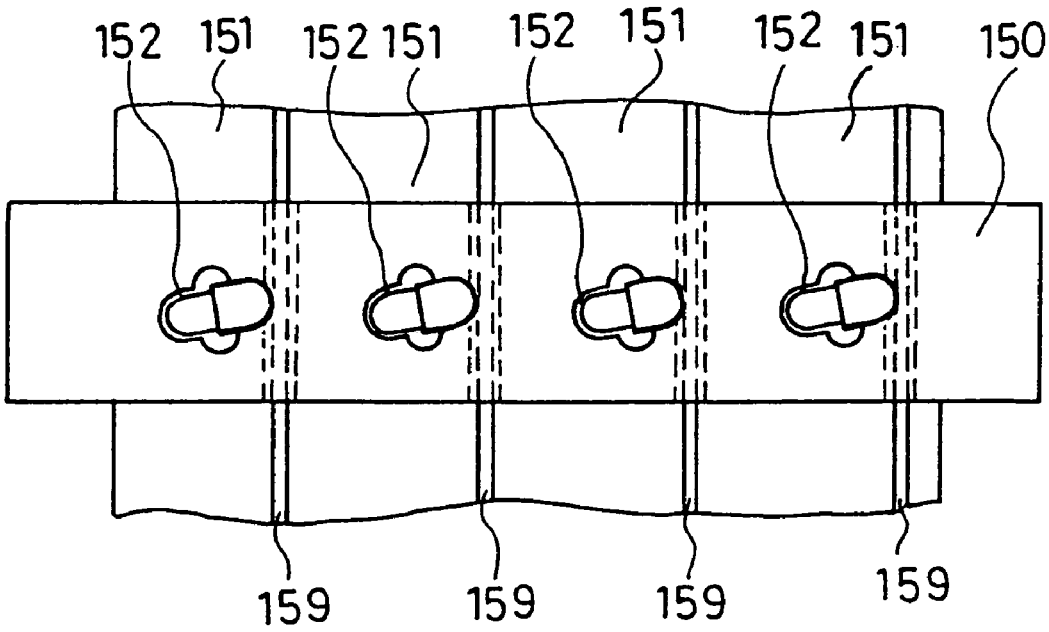
FIG. 12 is a plan view showing part of one slat 150 in the capsule filling-sealing apparatus in accordance with Embodiment 1.
Figure 13:
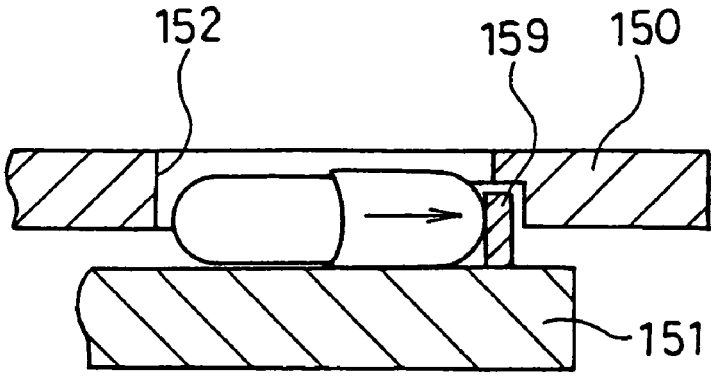
FIG. 13 is a cross-sectional view showing a capsule insertion hole 152 formed in the slat 150 in the capsule filling-sealing apparatus in accordance with Embodiment 1.

FIG. 12 is a plan view showing part of one slat 150. FIG. 13 is a cross-sectional view showing the capsule insertion holes 152 formed in the slat 150.

As shown in FIG. 12, the capsule insertion hole 152 is a slot having a length slightly larger than the axial length of the filled capsule and has a shape expanding outward at its central portion. A plurality of filled capsules arranged in the same axial direction, having been delivered by compressed air from the capsule holding holes 148 of the transfer roller 143, are accommodated in the plurality of capsule insertion holes 152 provided in one slat 150 in its width direction (in the right-left direction of FIG. 12). Each filled capsule accommodated in the capsule insertion hole 152 can rotate on its axis in its circumferential direction while the movement in its axial direction is restricted. At this time, each filled capsule is supported by the bottom plate 151. As described above, each row of filled capsules is fed sequentially from the transfer roller 143 to each slat 150.

In Embodiment 1, the capsule insertion hole 152 is formed so that the longitudinal center axis of the filled capsule to be accommodated is inclined by a desired angle with respect to the direction perpendicular to the traveling direction of the slat 150. This is intended to generate a force for moving the filled capsule in one direction and to carry out positioning when the filled capsule is transferred while rotating on its axis and making frictional contact with the bottom plate 151. In other words, since the filled capsule rotating on its axis is transferred in a direction deviated by the desired angle from the direction perpendicular to the rotation axis of the rotation on its axis, a movement force is generated in one direction (a direction toward the cap in the axial direction of the capsule) inside the capsule insertion hole 152, whereby the capsule is positioned while its cap side always makes contact with an axial positioning guide 159 (see FIG. 13).

The filled capsules inserted into the slats 150 as described above are transferred continuously to the downstream side by the circulation drive of the slats 150 while rotating on the bottom plates 151 and being guided by the slats 150.

Figure 14:
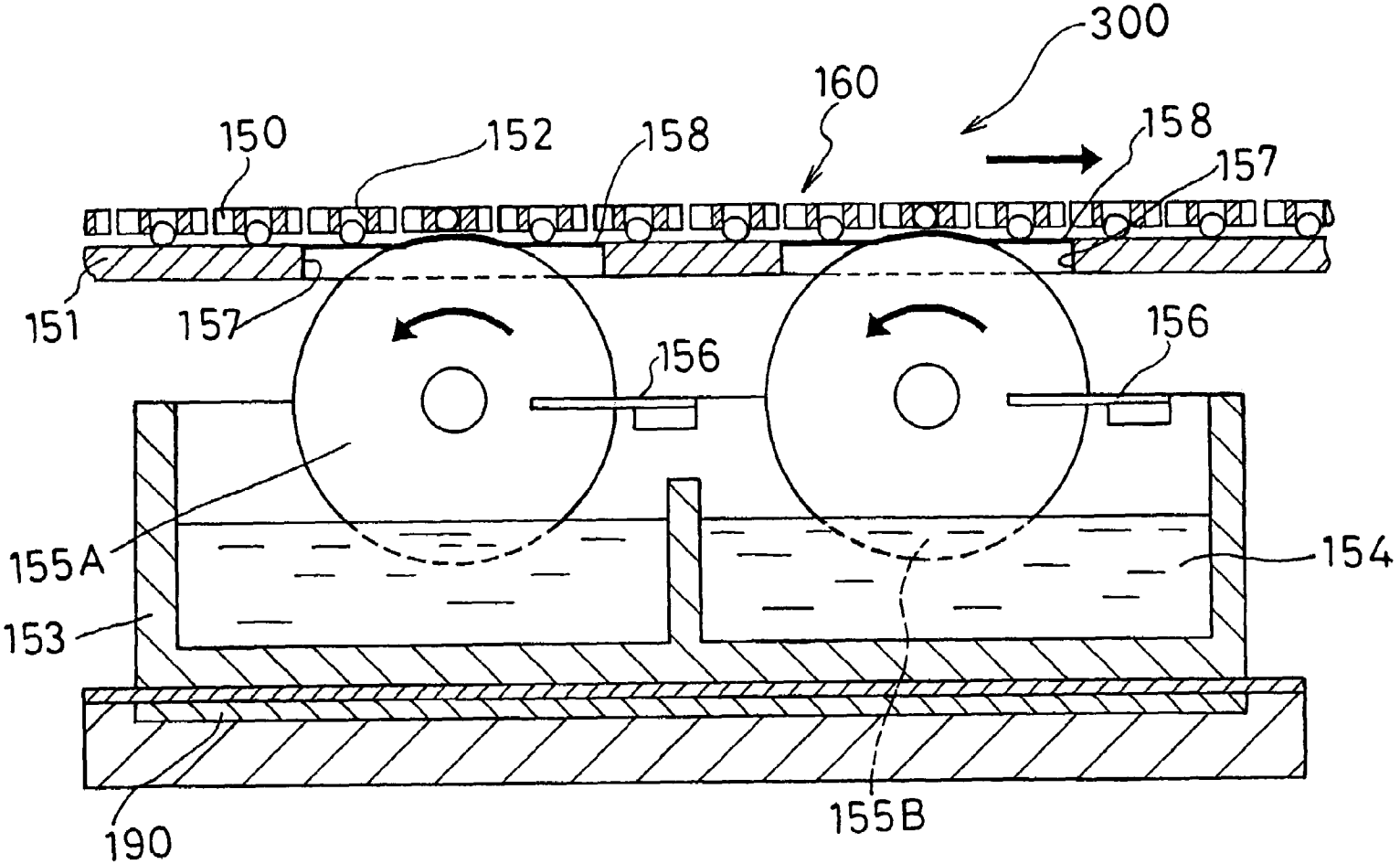
FIG. 14 is a side cross-sectional view showing a sealing mechanism 160 provided at the intermediate portion of the capsule transfer means of the sealing unit 300 in the capsule filling-sealing apparatus in accordance with Embodiment 1.

The filled capsules transferred by the slats 150 as described above are fed into a sealing mechanism 160 provided on its downstream side. FIG. 14 is a side cross-sectional view showing the sealing mechanism 160 provided at the intermediate portion of the capsule transfer means in the sealing unit 300.

In the sealing mechanism 160, a sealing liquid bath 153 is provided below the bottom plates 151. Inside this sealing liquid bath 153, a sealing liquid 154 is stored. In this sealing liquid 154, first sealing rollers 155A and second sealing rollers 155B, made of stainless steel, are disposed so as to be dipped partially. The first sealing roller 155A and the second sealing roller 155B are disposed in series on the same line, and respectively formed in multiple rows (five rows in Embodiment 1) in a direction perpendicular to the transfer direction. Each of the first sealing roller 155A and the second sealing roller 155B is a thin disc, and its thickness becomes the band seal width of the filled capsule. In addition, the first sealing rollers 155A and the second sealing rollers 155B are configured so as to be movable vertically and go up and down as desired. The first sealing rollers 155A and the second sealing rollers 155B go up during sealing operation to make contact with the filled capsules. Furthermore, when the maintenance operation and the like, such as replenishment of the sealing liquid 154, are carried out, the first sealing rollers 155A and the second sealing rollers 155B go down, and the sealing mechanism can be removed as one unit to the side of the production line.

The sealing liquid 154 inside the sealing liquid bath 153 is always replenished from an auxiliary tank provided inside the apparatus, whereby the liquid level in the sealing liquid bath 153 is always maintained constant. In addition, below the sealing liquid bath 153, a film heater 190 for keeping the temperature of the sealing liquid bath 153 at a predetermined temperature (40° C. to 50° C. in Embodiment 1).

The two sealing devices in the sealing mechanism 160 are substantially the same in configuration; hence, in the following description, the first sealing rollers 155A will be described, and the description of the second sealing rollers 155B is omitted.

The first sealing rollers 155A are rotated counterclockwise, that is, in a direction opposite to the transfer direction of the slats 150, by a motor 196 (FIG. 10) serving as a drive source. The sealing liquid 154 attaches to the surfaces of the first sealing rollers 155A. One scraper 156 is installed in the vicinity of the external face of the first sealing roller 155A to make the attachment amount of the sealing liquid 154 constant. An extra amount of the sealing liquid 154 on the first sealing roller 155A is scraped off by this scraper 156. A U-shaped cutout portion is formed in the scraper 156 so that the first sealing roller 155A is disposed therein, whereby the sealing liquid 154 attached to both side faces of the first sealing roller 155A is scraped off by both side faces of the cutout portion of the scraper 156, and an amount exceeding a predetermined amount of the sealing liquid 154 attached to the external circumferential face of the first sealing roller 155A is scraped off by the bottom face of the cutout portion.

As shown in FIG. 14, an insertion hole 157 is formed in the bottom plate 151 at a position wherein the first sealing roller 155A is disposed when it is rotated and driven. In addition, in the vicinity of the upper end of the first sealing roller 155A in this insertion hole 157, a circular-shaped guide 158 whose central portion protrudes upward is provided on both sides of the insertion hole 157. Furthermore, the above-mentioned axial positioning guide 159 is provided on the outside of one of the circular-shaped guides 158 to restrict the axial position of the filled capsule. Hence, the filled capsule transferred to the sealing position while being guided by the slat 150 is transferred while the tip of its cap first makes contact with the wall of the axial positioning guide 159 so that its axial position is restricted. Next, the filled capsule rises over the upper fringe portions of the circular-shaped guides 158 and moves while its axial position is restricted. This circular-shaped guide 158 is configured so as to have a circular shape having a radius nearly identical to that of the circular shape of the first sealing roller 155A, and so that the external circumferential portion of the first sealing roller 155A makes contact with the connection portion of the cap and the body.

Figure 15:
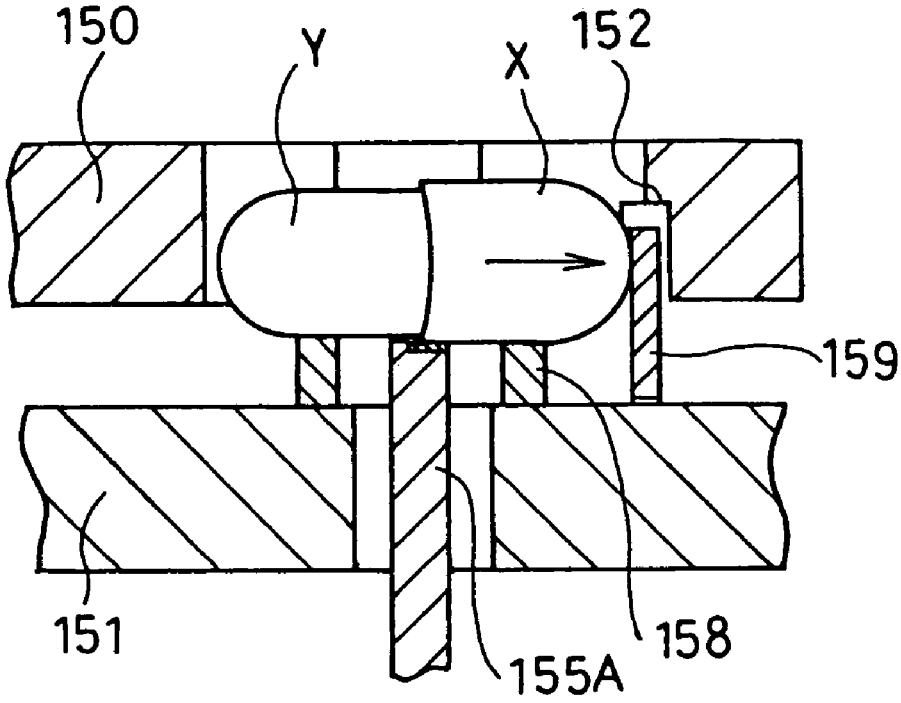
FIG. 15 is a cross-sectional view showing a state wherein a filled capsule comprising a cap and a body connected to each other is guided by circular-shaped guides 158 and makes contact with a first sealing roller 155A while the apex portion of the cap is guided by a guide 159 in the capsule filling-sealing apparatus in accordance with Embodiment 1.

FIG. 15 is a cross-sectional view showing a state wherein the filled capsule comprising the cap (X) and the body (Y) connected to each other is guided by the circular-shaped guides 158 and makes contact with the first sealing roller 155A. As shown in FIG. 15, in the zone guided by the circular-shaped guides 158, the sealing liquid 154 attaching to the external circumferential portion of the first sealing roller 155A is applied to the connection portion of the filled capsule. At this time, the first sealing roller 155A rotates in a direction opposite to the transfer direction of the filled capsule, whereby the filled capsule rotates on its axis in a direction opposite to the rotation direction of the first sealing roller 155A. The number of rotations of the filled capsule on its axis can be changed to a desired number of rotations by controlling the rotation speed of the first sealing roller 155A using a motor. In Embodiment 1, the filled capsule rotates three times in the application zone, and the sealing liquid is applied three times to the entire circumference of the connection portion of the cap (X) and the body (Y), whereby a band seal is formed.

As the sealing liquid 154 being used in Embodiment 1, a base material compatible with the capsule (film), such as a solution of gelatin or cellulose derivative is used preferably, and a coloring agent may be added thereto as desired. By the film heater 190 provided below the sealing liquid bath 153, the sealing liquid 154 is always kept at a temperature of 40° C. to 50° C., for example, in the case of a gelatin solution. The film heater being used in Embodiment 1 is a flexible flat heater having a thickness of approximately 1.0 mm in which glass-cloth-impregnated silicone rubber serving as a heat-resistant insulation layer is bonded on both sides of nickel-chromium-based alloy foil. In addition, warm water may be circulated inside the sealing liquid bath 153 to keep the sealing liquid 154 at a predetermined temperature.

In Embodiment 1, the sealing devices being configured similarly are provided at two stages in series on one line as described above; a band seal is formed at the connection portion of the filled capsule by the sealing device of the first stage, and then the sealing device being similar thereto carries out second sealing operation for the filled capsule. Hence, the sealing operation for the filled capsule in Embodiment 1 is made secure.

In Embodiment 1, although the first sealing device and the second sealing device are configured similarly, they are different partially in the shapes of the sealing rollers 155A and 155B.

Figure 16:
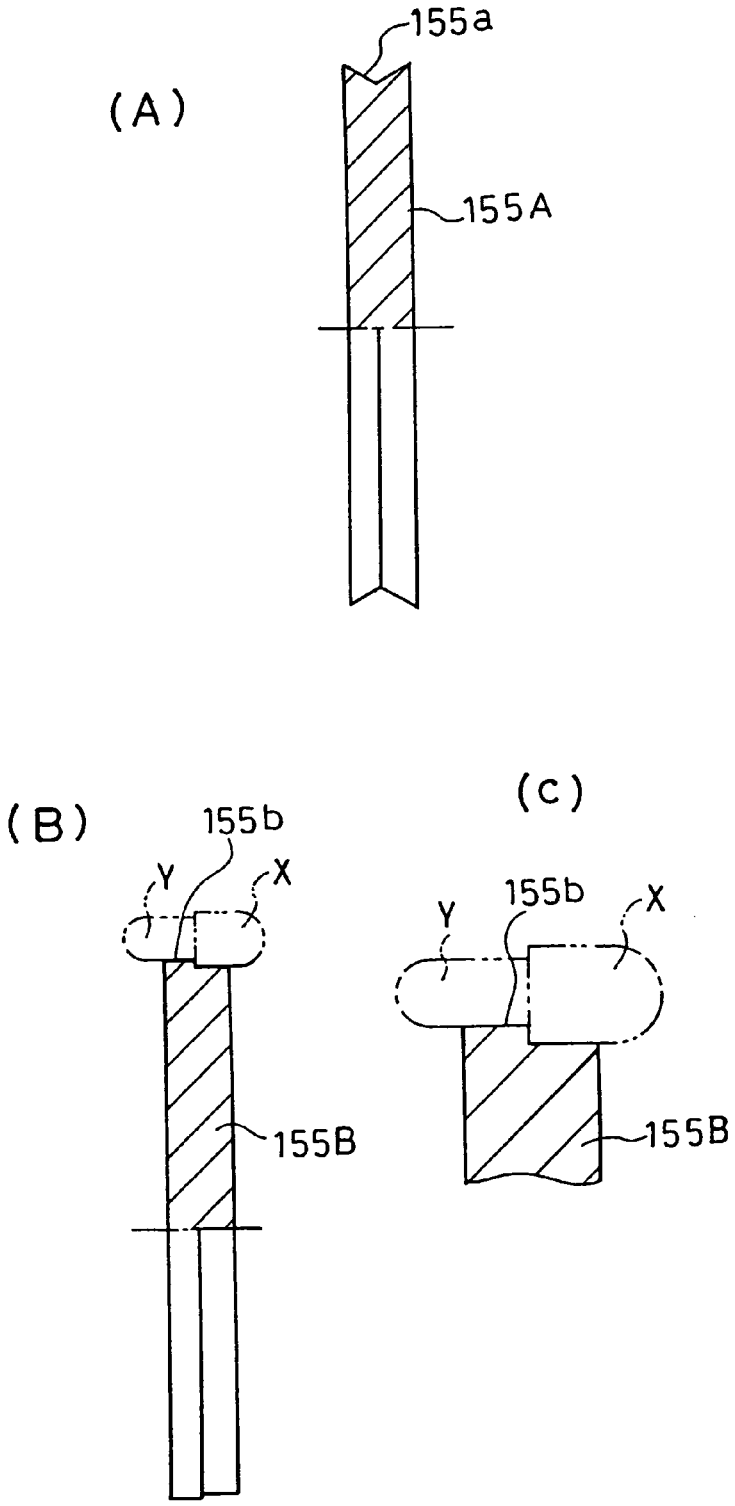
FIG. 16 is a partially cross-sectional view showing the cross-sectional shapes of the first sealing roller 155A and a second sealing roller 155B in the capsule filling-sealing apparatus in accordance with Embodiment 1.

FIG. 16 is a cross-sectional view showing the respective cross-sectional shapes of the first sealing roller 155A (part (A) of FIG. 16) and the second sealing roller 155B (part (B) of FIG. 16). Part (C) of FIG. 16 is a magnified view of the upper end of the second sealing roller 155B. In the respective drawings of parts (A) and (B) of FIG. 16, only the upper-half portions of the first sealing roller 155A and the second sealing roller 155B are shown in cross section.

As shown in part (A) of FIG. 16, the external circumferential face 155*a* of the first sealing roller 155A is recessed at the central portion and thus has a V-shaped dent, and the sealing liquid 154 is stored in this dent. As shown in parts (B) and (C) of FIG. 16, the external circumferential face 155*b* of the second sealing roller 155B has a step formed so as to be adapted for the side shape of the connection portion of the capsule. Hence, when the second sealing roller 155B carries out sealing operation for the filled capsule, the step at the connection portion of the cap (X) and the body (Y) of the filled capsule is aligned with the step of the second sealing roller 155B and makes contact with each other under pressure. In this way, the external circumferential face 155*b* of the second sealing roller 155B is pushed against the sealing liquid 154 having been applied to the connection portion of the filled capsule by the first sealing roller 155A, whereby bubbles caused inside the sealing liquid 154 during the sealing processing in the first sealing device are pushed out, and unevenness of sealing is corrected.

Figure 17:
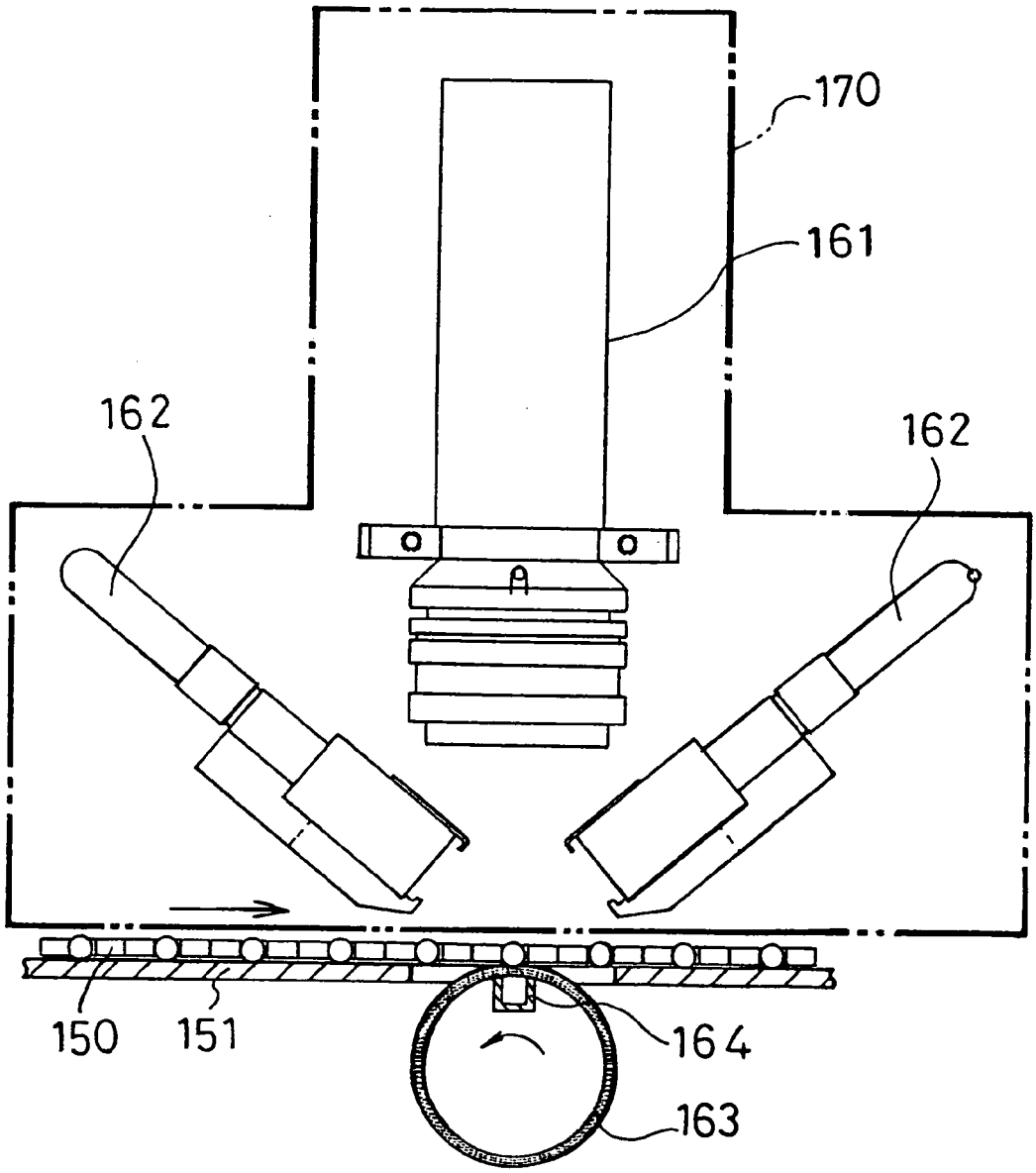
FIG. 17 is a side view showing the internal configuration of a sensor section 170 in the capsule filling-sealing apparatus in accordance with Embodiment 1.

The capsules (hereafter referred to as sealed capsules) obtained after the filled capsules are subjected to the sealing processing as described above are transferred by the slats 150 to a sensor section 170. FIG. 17 is a side view showing the internal configuration of the sensor section 170 in accordance with Embodiment 1. As shown in FIG. 17, the sensor section 170 comprises a line sensor camera 161 and two illumination sections 162 and 162 installed together in the transfer direction. In addition, a sensor roller 163, part of which is inserted in the opening of the bottom plate 151, is provided directly below the line sensor camera 161 and below the slats 150. As shown in FIG. 17, a vacuum passage 164 is formed inside the sensor roller 163 at the position (the top position) opposed to the sealed capsule. Furthermore, a plurality of through holes for communication between the internal space and the external space are formed in the sensor roller 163. Since the vacuum passage 164 is provided at the position of the sensor roller 163, opposed to the sealed capsule, as described above, the sealed capsule having reached the sensor detection position directly below the line sensor camera 161 is sucked by the sensor roller 163 being rotating, and is forcibly rotated on its axis. In Embodiment 1, the rotation speed of the sensor roller 163 is set so that the sealed capsule rotates 1.5 turns while it moves by 1 mm when passing through the sensor detection position.

The sensor section 170 configured as described above scans the surface of the sealed capsule to detect any defect at the band seal portion of the sealed capsule. For example, the sealing width is detected, and liquid leakage and other defects are inspected. If a defective sealed capsule is found in the sensor section 170, its position is memorized, and it is ejected from the line by a suction means (not shown) ahead of the drying unit 400 at the subsequent stage.

As a specific example of the sensor section 170 in accordance with Embodiment 1, its processing capability per hour was 40,000 pieces in the case of five rows since the transfer speed was 55.9 mm/s. Furthermore, according to the specifications of the line sensor camera 161 being used in Embodiment 1, the clock number was 40 MHz, the number of camera bits per one scanning was 5150 bits, and the scanning width was 130 mm.

At the downstream of the sensor section 170 of the sealing unit 300 for forming the sealed capsules as described above, the drying unit 400 for drying the band seal portions of the sealed capsules to form completed capsules is provided.

The sensor section 170 may be configured so as to inspect not only the band seals of the filled capsules but also the external appearances of the capsules.

[Drying Unit 400]

Figure 18:
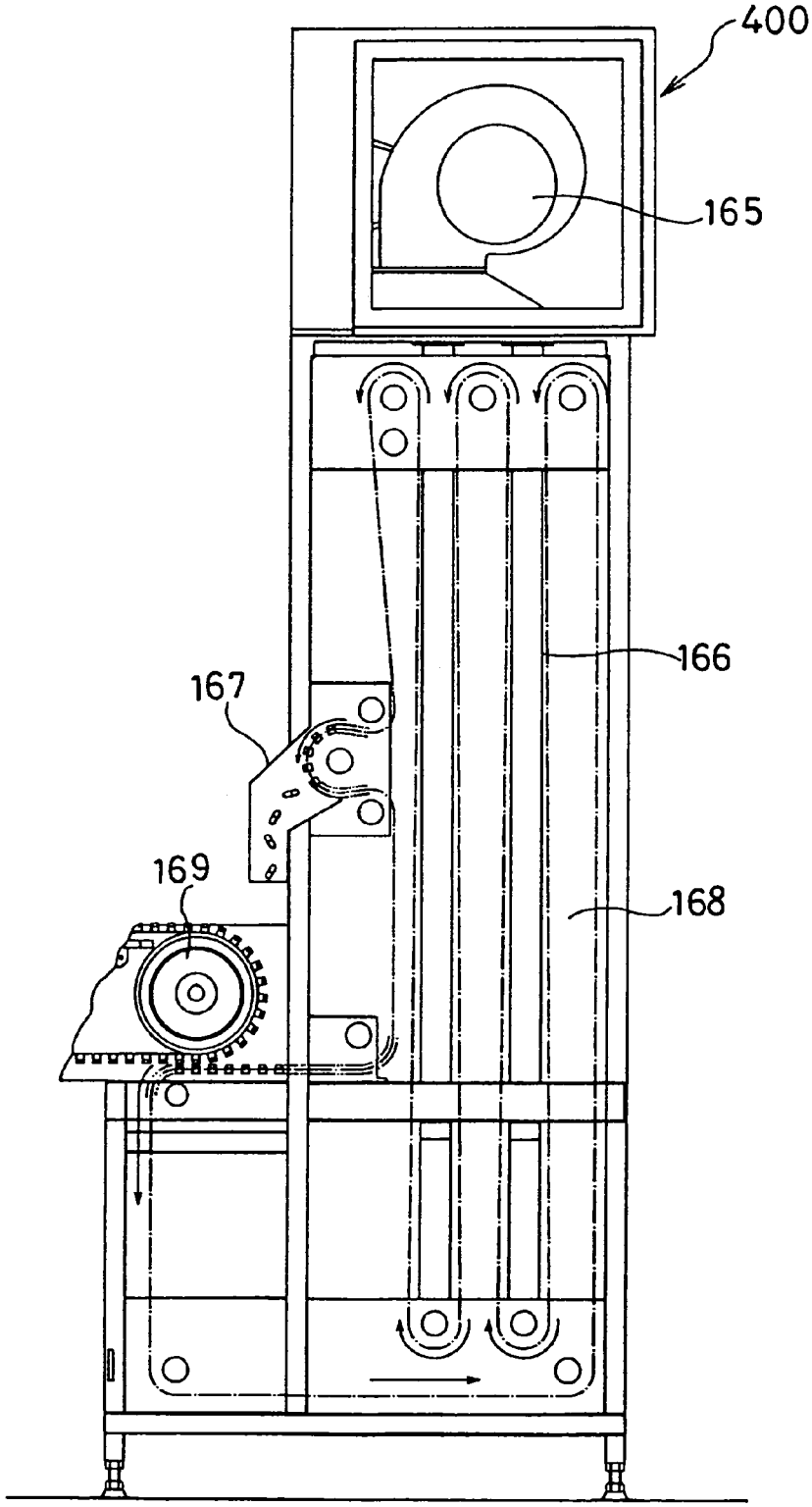
FIG. 18 is a side view showing the configuration of a drying unit 400 in the capsule filling-sealing apparatus in accordance with Embodiment 1.

FIG. 18 is a side view showing the configuration of the drying unit 400. As shown in FIG. 18, a blower 165 is disposed at the upper portion of the drying unit 400. The drying unit 400 is configured so as to send room-temperature air via a filter into a capsule drying space 168 formed below the blower 165. A carrier 166 for holding and transferring the sealed capsules is disposed so as to meander vertically in the capsule drying space 168.

The sealed capsules held and transferred by the slats 150 and the bottom plates 151 in the sealing unit 300 are delivered to the carrier 166 of the drying unit 400 at the position below the drive roller 169 of the slats 150. The carrier 166 is configured so as to hold each row (there are five rows in Embodiment 1) of the sealed capsules in the horizontal direction using one holding plate, and the support point and the center of gravity of each holding plate are restricted so that its capsule holding face is turned upward. While holding the sealed capsules as described above, the carrier 166 meanders in the capsule drying space 168 to transfer the capsules. A duct is formed so that the blower 165 blows room-temperature air filtered by the filter to this capsule drying space 168 from the upper and side faces thereof. As a result, drying processing for the band seals of the sealed capsules inside the capsule drying space 168 is carried out securely without causing reduction in moisture content of the capsules. Each holding plate for holding respective sealed capsules having passed through the capsule drying space 168 makes contact with a guide plate (not shown) in a product discharge region, and its behavior is restricted; the holding plate then turns over sideways, and completed capsules, i.e., products, are ejected are ejected from a product discharge port 167. At this time, the band seal at the connection portion of the cap and the body is dried completely. The time required for this band seal drying is set usually in the range of 3 to 10 minutes, although the time slightly depends on the formulation of the band sealing liquid.

As described above, the capsule filling-sealing apparatus in accordance with Embodiment 1 of the present invention can continuously carry out the filling processing and the sealing processing on the same production line by feeding empty capsules being in the temporary connection state and filling material.

Conventionally, the filling processing and the sealing processing for capsules were carried out on separate production lines; hence, in the case when the filling material was in the form of liquid, liquid leakage occurred occasionally during transfer from the production line for the filling processing to the production line for the sealing processing. The inventors conducted an experiment by using a conventional filling apparatus; in the case when capsule filling processing was carried out by using medium-chain fatty acid triglyceride having a kinematic viscosity of approximately 25 centistokes as a liquid filling material having a low viscosity, it was confirmed that the filling material leaked occasionally from the clearance in the connection portion of the cap and the body approximately 10 seconds after the filling processing. In the capsule filling-sealing apparatus in accordance with Embodiment 1 of the present invention, the processing time from the end of the filling processing to the end of the sealing processing is a short time of approximately 8.5 seconds, and the filled capsules are transferred smoothly on the same production line without causing extra vibration. As a result, in the capsule filling-sealing apparatus in accordance with Embodiment 1, the sealing processing can be carried out securely without causing liquid leakage after the filling processing.

Figure 19:
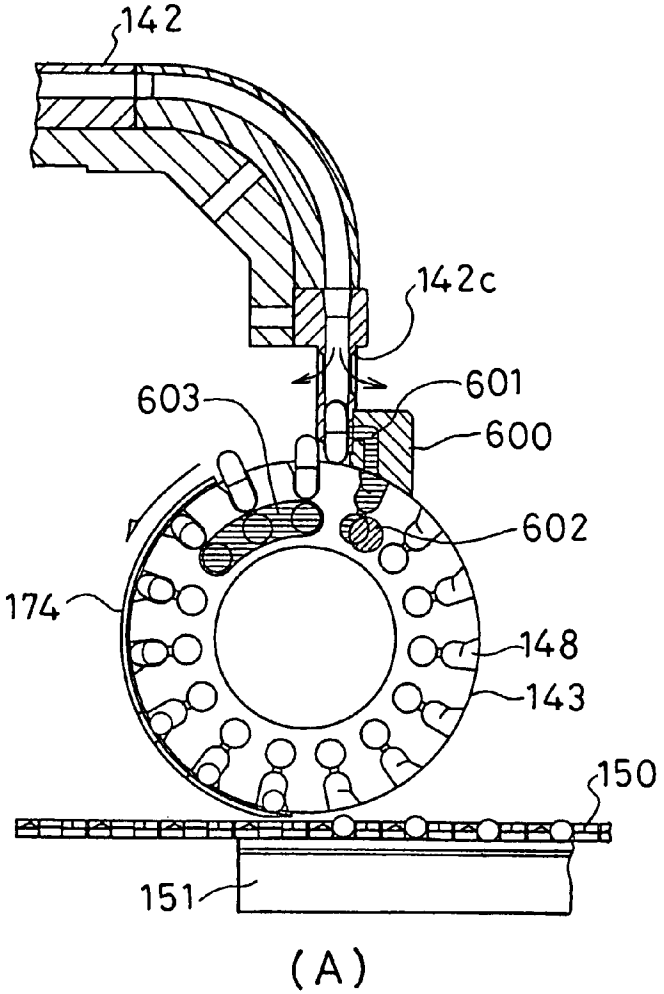
FIG. 19 is a side cross-sectional view showing a crack prevention guide for use in the connection unit in the capsule filling-sealing apparatus in accordance with Embodiment 1.
Figure 19:
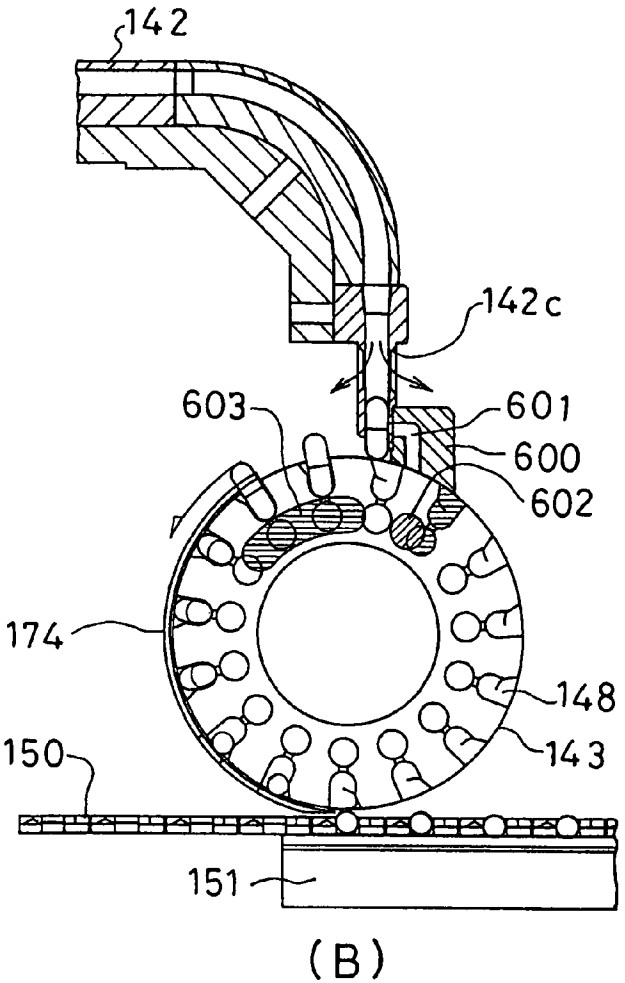

FIG. 19 is a side cross-sectional view showing an example wherein a crack prevention guide 600 is provided at the portion of delivering the filled capsules from the connection chute 142 to the transfer roller 143 in the above-mentioned connection unit 200. The filled capsules transferred at high speed inside the connection chute 142 by compressed air collide with the external circumferential face of the transfer roller 143, thereby having a danger of being cracked by the collision. The crack prevention guide 600 reduces the speed of the filled capsules being transferred inside the connection chute 142.

As shown in FIG. 19, the crack prevention guide 600 is installed in the vicinity of the rear end of the connection chute 142 along the external circumferential face of the transfer roller 143. In the crack prevention guide 600, a bypass passage 601 communicating with the various transfer passages inside the connection chute 142 is formed. The bypass passage 601 is formed so as to communicate with the capsule holding holes 148 immediately ahead of the top portion of the transfer roller 143 when the filled capsules reach the external surface of the transfer roller 143. Hence, when the filled capsules reach the external surface of the transfer roller 143, the transfer passages inside the connection chute 142 communicate with the capsule holding holes 148 via the bypass passage 601. At this time, the capsule holding holes 148 being communicated is connected to a first vacuum passage 602. In addition, in the transfer roller 143, a second vacuum passage 603 is connected to the plurality of capsule holding holes 148 having passed the top portion. This second vacuum passage 603 is used to securely hold the filled capsules accommodated in the capsule holding holes 148 of the transfer roller 143.

As shown in part (A) of FIG. 19, the upper opening of the bypass passage 601 of the crack prevention guide 600 is formed so that it becomes close to the filled capsules when the filled capsules reach the external circumferential face of the transfer roller 143. At this time, since the bypass passage 601 is communicated with the first vacuum passage 602, the filled capsules are pulled toward the side of the transfer passage by a certain suction force. This suction force is not strong enough to suck the filled capsules to the opening of the bypass passage 601.

In addition, a vent hole 142*c* for releasing the compressed air passing through the transfer passage to the outside air is formed in the connection chute 142. Since the compressed air for transferring the filled capsules is released to the outside via this vent hole 142*c*, the filled capsules are transferred smoothly from the connection chute 142 to the transfer roller 143.

As shown in part (B) of FIG. 19, when the filled capsules reach the external circumferential face of the transfer roller 143, since the transfer roller 143 is rotating (in the counter-clockwise direction in FIG. 19), the filled capsules slide on the external circumferential face of the transfer roller 143 and drop inside the capsule holding holes 148.

Since the crack prevention guide 600 is provided at the portion of delivering the filled capsules from the connection chute 142 to the transfer roller 143 as described above, when the filled capsules reach the transfer roller 143, the filled capsules are decelerated and securely accommodated inside the capsule holding holes 148 of the transfer roller 143 without bounding. As a result, cracking or breakage that may occur when the filled capsules make contact with the transfer roller 143 can be prevented securely.

Figure 20:
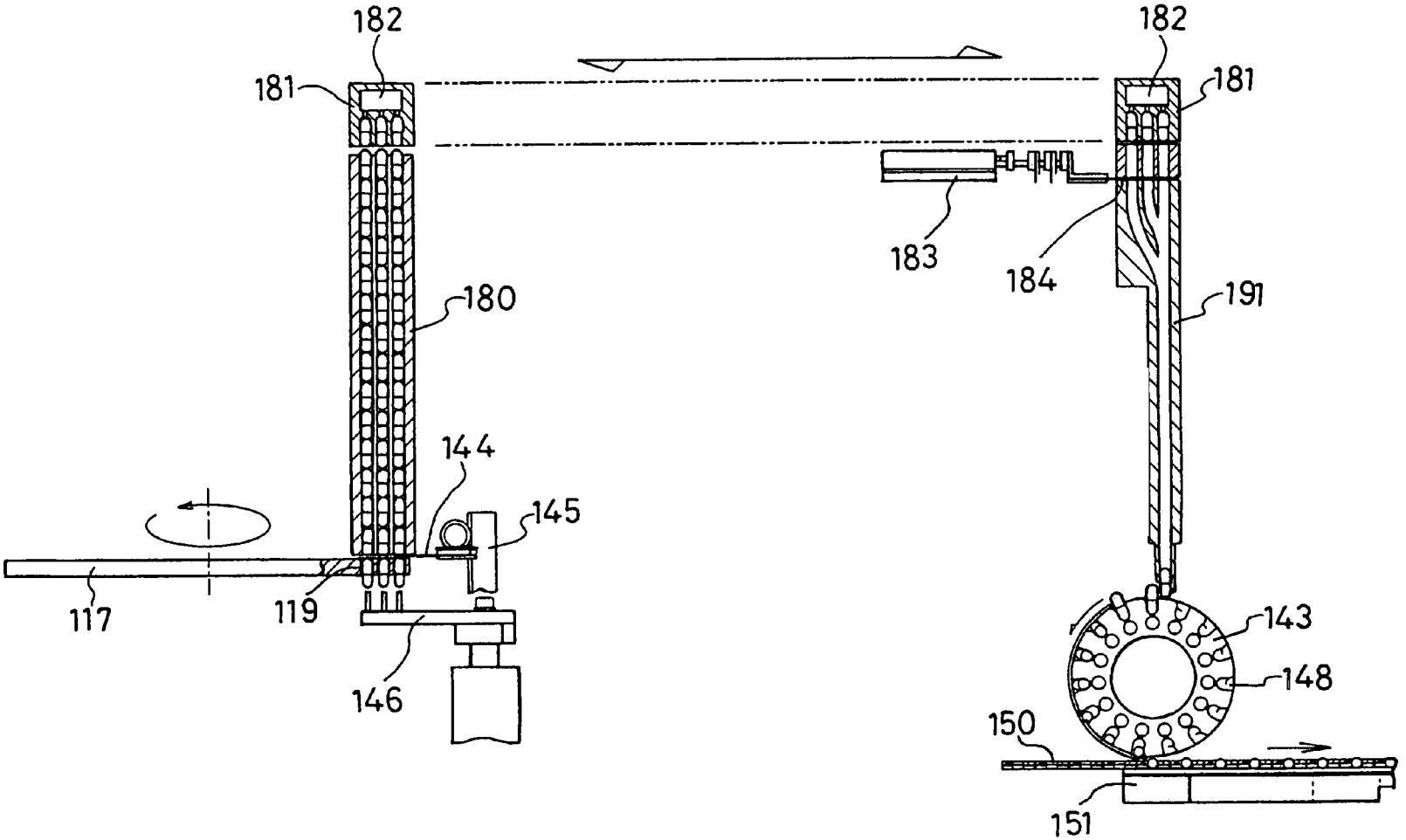
FIG. 20 is a view showing the configuration of a connection unit in accordance with another embodiment of the capsule filling-sealing apparatus of the present invention.
Figure 21:
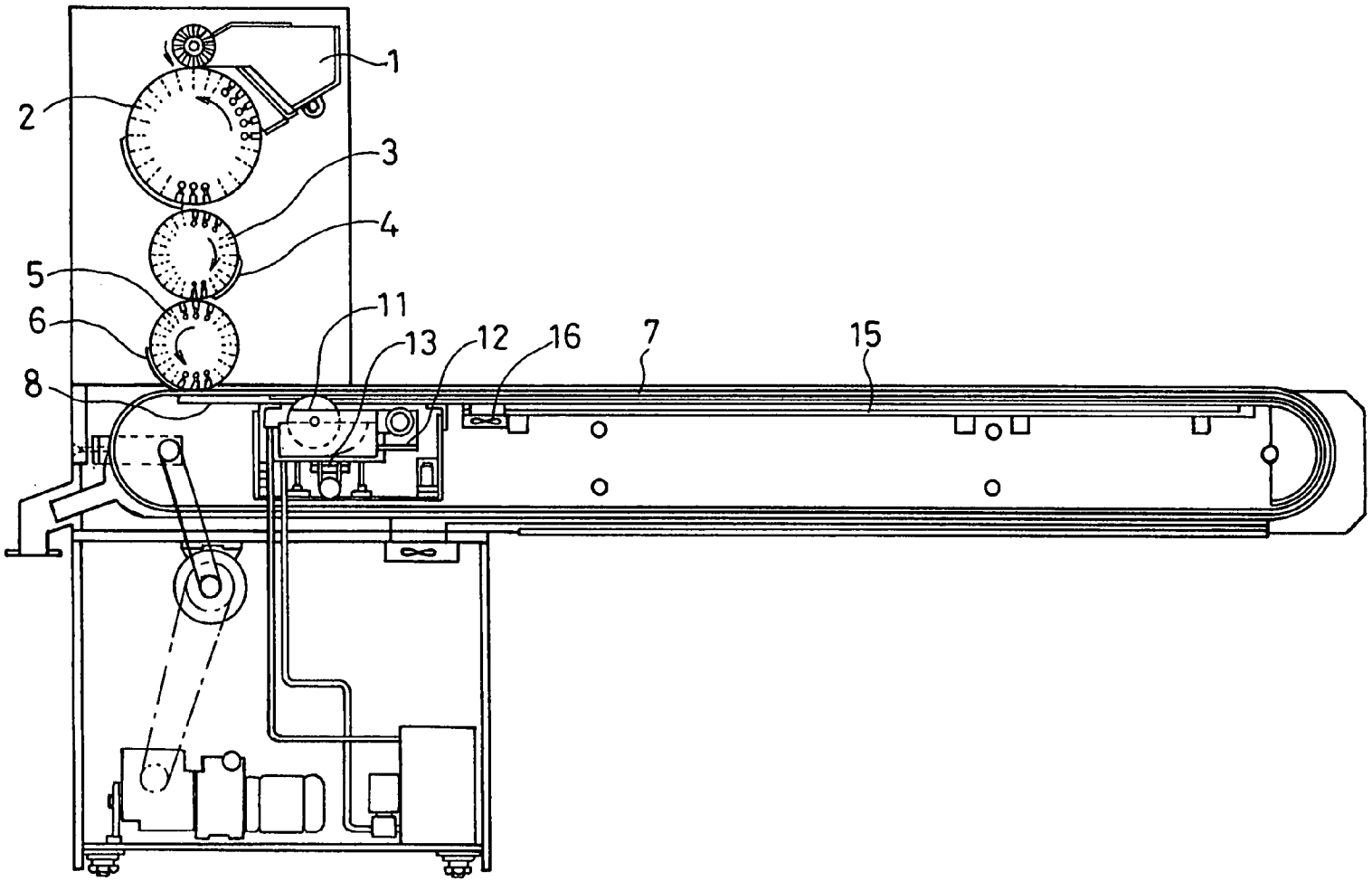
FIG. 21 is the side view showing the entire configuration of the conventional capsule sealing apparatus.

In the capsule filling-sealing apparatus in accordance with Embodiment 1 of the present invention, an example has been described wherein the connection unit 200 shown in FIG. 11 is used; however, the present invention can be configured by using a connection unit having a different configuration. For example, the connection unit shown in FIG. 20 can also be used. In the case when, for example, an oily filling material is heated so as to lower its viscosity and then used for filling, the connection unit shown in FIG. 20 is provided with a cooling section 180 for holding the filled capsules by stacking them vertically to securely obtain a cooling region after the heating and filling. The filled capsules held in the cap accommodating pockets 119 of the cap holding disc 117 are pushed up by a discharge pusher 146 and inserted from the lower portion of the cooling section 180, thereby accommodated sequentially. At this time, the shutter 144 provided between the cap accommodating pockets 119 and the cooling section 180 is opened. In the cooling section 180, the filled capsules are inserted from the lower portion and moved upward gradually; this movement period becomes a cooling period after the heating and sealing.

Above the cooling section 180, a transfer block 181 for receiving the filled capsules from the cooling section 180 and holding them is provided. The transfer block 181 is configured so as to be able to reciprocate between the cooling section 180 and a transfer section 191 described later. Furthermore, the transfer block 181 is provided with a pressure adjustment port 182 that can be switched between a vacuum passage capable of sucking the filled capsules and a compressed air passage for pushing out the filled capsules.

The filled capsules disposed at the uppermost portion inside the cooling section 180 are accommodated inside the transfer block 181 by the suction through a nozzle communicated with the vacuum passage of the pressure adjustment port 182 of the transfer block 181 and by the pushing-up operation of the discharge pusher 146 from below, and then held therein. The transfer block 181 holding the filled capsules is transferred above the transfer section 191. At this time, the pressure adjustment port 182 of the transfer section 191 is switched from the vacuum passage so as to communicate with the compressed air passage.

As shown in FIG. 20, the transfer section 191 is provided with a plurality of passages through which the plurality of filled capsules held in the transfer block 181 pass respectively. A shutter 184 reciprocated by an air cylinder 183 provided in the transfer section 191 is configured so as to control the sequential transfer of the filled capsules to the transfer roller 143. In the transfer section 191 configured as described above, the filled capsules held in the transfer block 181 pass through the passages of the transfer section 191 by virtue of the intermittent operation of the shutter 184 and are sequentially inserted into the capsule holding holes 148 of the transfer roller 143.

As clarified by the above detailed descriptions of the embodiments, the present invention has the following effects.

The present invention is configured to carry out the filling processing and the sealing processing on the same production line without requiring unnecessary transfer and storage after the filling processing for capsules. Therefore, the present invention can provide a compact and laborsaving capsule filling-sealing apparatus capable of securely carrying out highly accurate filling and sealing.

In addition, with the present invention, the sealing processing is carrying out sequentially after the filling processing on the same production line, whereby the processing time from filling to sealing is short and capsule accumulation does not occur. Hence, even when the filling material is a liquid having a low viscosity, liquid leakage from the capsules can be suppressed significantly.

Furthermore, the present invention is configured so that the filling unit in which various mechanisms for carrying out the filling processing for the capsules are functionally disposed, the connection unit for transferring the filled capsules to the sealing unit, and the sealing unit for securely sealing the filled capsules are linked organically. Moreover, the present invention is configured so that the respective units are driven by a substantially single drive source. Therefore, the present invention can provide a compact and highly productive capsule filling-sealing apparatus.

In addition, in the capsule filling-sealing apparatus in accordance with the present invention, the capsule orienting processing, filling processing, sealing processing, etc. are carried out continuously on one production line during the period from the feeding of empty capsules to the discharge of products, whereby the processing time for capsule filling and sealing can be shortened significantly.

Furthermore, the capsule filling-sealing apparatus in accordance with the present invention is configured so as to continuously transfer the filled capsules to the sealing mechanism by using the connection unit, and the sealing mechanism is provided with the sealing means comprising the two-stage sealing rollers. Therefore, the capsule filling-sealing apparatus in accordance with the present invention can significantly shorten the processing time from the filling processing to the sealing processing and can securely carry out the sealing processing for the filled capsules.

Moreover, the capsule filling-sealing apparatus in accordance with the present invention is configured so that the tip of the nozzle is disposed inside the body by raising the body of the capsule during the filling operation, whereby the filling material can be prevented from splashing during the filling operation.

Still further, the capsule filling-sealing apparatus in accordance with the present invention is configured so that the presence or absence of defective capsules is detected at the preceding stage of the filling processing, so that the detected defective capsules are securely ejected to the outside of the system and so that the filling processing is not carried out at the positions having no capsules. Therefore, the capsule filling-sealing apparatus in accordance with the present invention can raise productivity.

Still further, the present invention is configured so that the capsules subjected to the filling processing are directly transferred to the sealing processing, whereby it is not necessary to provide a special mechanism for controlling the postures of the capsules at the preceding stage of the sealing processing and the entire apparatus can be made compact.

Still further, the capsule filling-sealing apparatus in accordance with the present invention is configured so that the sensor section is provided to inspect the states of the band seal portions and the external appearances of the capsules after the sealing processing, whereby the reliability of the completed capsules can be raised further.

INDUSTRIAL APPLICABILITY

The capsule filling-sealing apparatus in accordance with the present invention is an apparatus for automatically filling capsules made of a water-soluble material, such as gelatin or cellulose, with medicines or food products in the form of powder, granule, liquid, etc. and for sealing the capsules, thereby being a useful apparatus capable of being used for the production of various capsules.

The invention claimed is:

1. A capsule filling-sealing apparatus comprising:

a capsule filling section, having a turntable holding empty capsules and rotating intermittently at intervals of a constant rotation angle, configured to sequentially carry out a separation process for separating the body and the cap of said empty capsule at the stop position of the intermittent rotation of said turntable, a filling process for filling said body with a filling material, a connection process for connecting said body with said cap to form each of filled capsules, and a transfer process for discharging said filled capsules to the next process, a capsule transfer section for sequentially receiving and holding said filled capsules from said capsule filling section and for transferring said filled capsules while controlling said filled capsules in a desired posture, and a capsule sealing section having a transfer mechanism for receiving said filled capsules from said capsule transfer section and for transferring them in a substantially horizontal direction, and a sealing mechanism for forming a band seal at the connection portion of the cap and the body of said filled capsule to form each of sealed capsules, wherein said capsule transfer section comprises a discharge roller for sequentially receiving said filled capsules from said capsule filling section and for holding them, a connection chute having passages for discharging said filled capsules from said discharge roller and for transferring them using compressed air, and a transfer roller for receiving said filled capsules from said connection chute and for controlling said filled capsules in a desired posture, and said capsule filling section, said capsule transfer section and said capsule sealing section are configured integrally so that the production from empty capsules to completed capsules is carried out on the same production line.

2. The capsule filling-sealing apparatus in accordance with claim 1, wherein said capsule filling section is configured in which said empty capsule is separated into a body and a cap, said cap is held in a cap holding disc, said body is held in a body holding disc, and said cap holding disc and said body holding disc rotate intermittently together with the turntable at intervals of a constant rotation angle, and in the filling operation for filling said body with said filling material, said body held in said body holding disc is raised, and the tip of a nozzle for discharging said filling material is disposed inside said body.

3. The capsule filling-sealing apparatus in accordance with claim 1, wherein said discharge roller of said capsule transfer section is configured to receive a plurality of filled capsules and defective capsules held in said cap holding disc and to hold them by suction while rotating intermittently, to discharge said filled capsules to the capsule discharge port of said connection chute disposed at a predetermined position in the vicinity of the external circumferential face of said discharge roller, and to feed said defective capsules to a defective capsule discharge port disposed in the vicinity of the external circumferential face of said discharge roller at a position different from said capsule discharge port and to eject said defective capsules outside the production line.

4. The capsule filling-sealing apparatus in accordance with claim 1, wherein the capsule transfer section is configured in which capsule holding holes are formed on the external circumferential face of said transfer roller, said capsule holding holes are disposed at the position corresponding to the capsule discharge port of said connection chute by virtue of the rotation of said transfer roller, each of said capsule holding holes comprises a horizontal hole being substantially parallel to the center axis of said transfer roller and a vertical hole extending substantially vertically to said center axis at one end of the bottom face of said horizontal hole, said vertical hole has a depth smaller than the longitudinal axial length of said filled capsule, and said filled capsules discharged from said capsule discharge port and accommodated in said vertical holes are guided by a guide plate disposed in the vicinity of the external circumferential face of said transfer roller and accommodated in said horizontal holes.

5. The capsule filling-sealing apparatus in accordance with claim 1, wherein said transfer mechanism of said capsule sealing section is configured to comprise slats for guiding said filled capsules so as to be movable freely and bottom plates, disposed in the vicinity of the lower faces of said slats, for supporting said filled capsules, in which each of said filled capsules received from said transfer roller makes contact with said bottom plate and rotates on its axis during transfer, and the direction perpendicular to the rotation axis of the rotation on its axis is different from the transfer direction, whereby said filled capsule is moved in one direction and positioned.

6. The capsule filling-sealing apparatus in accordance with claim 1, wherein said capsule sealing section is configured to comprise two sealing mechanisms disposed on the same transfer line, in which a first sealing mechanism applies a sealing liquid to the connection portion of the cap and the body of said filled capsule, and a second sealing mechanism pushes said connection portion in a way adapted for its shape to form a band seal.

7. The capsule filling-sealing apparatus in accordance with claim 6, wherein said first sealing mechanism has a first sealing roller having an external circumferential face partially dipped in said sealing liquid and making contact with the connection portion of said filled capsule, said second sealing mechanism has a second sealing roller having an external circumferential face partially dipped in said sealing liquid and making contact with said connection portion, the cross-sectional shape of the external circumferential face of said first sealing roller in a direction parallel to the rotation axis thereof has a concave shape, and the cross-sectional shape of the external circumferential face of said second sealing roller in a direction parallel to the rotation axis thereof is a step shape adapted for the shape of said connection portion.

8. The capsule filling-sealing apparatus in accordance with claim 1, wherein a sensor section for inspecting the external appearances of said sealed capsules is disposed at the latter stage of said capsule sealing section and comprises a sensor roller for forcibly rotating said sealed capsules located at the inspection position at a desired rotation speed from the lower face of said transfer mechanism and a line sensor camera for inspecting the sealing states of said connection portions of said sealed capsules at the detection position to detect defective band seals.

9. The capsule filling-sealing apparatus in accordance with claim 1, further comprising a capsule drying section for receiving said sealed capsules from said capsule sealing section and for drying the band seals of said connection portions.

10. The capsule filling-sealing apparatus in accordance with claim 9, wherein the capsule drying section is configured to comprise an endless capsule transfer mechanism disposed so as to meander vertically while holding said sealed capsules and a blower for blowing air from above and/or sides to said capsule transfer mechanism, in which said capsule transfer mechanism receives said sealed capsules, moves them by a predetermined distance to dry them, and discharges said sealed capsules as completed capsules.

11. The capsule filling-sealing apparatus in accordance with claim 1, wherein said capsule transfer section is configured to comprise a cylindrical cooling section for sequentially receiving said filled capsules from said capsule filling section and stacking and holding them, a capsule holding block configured to receive said filled capsules from said cooling section, to hold them and to be capable of moving them by a predetermined distance, a transfer section for receiving said filled capsules from said capsule holding block and for discharging said capsules in a desired sequence, and a transfer roller for transferring said filled capsules received sequentially from said transfer section to a transfer mechanism in the later stage while controlling the postures of said filled capsules.

12. The capsule filling-sealing apparatus in accordance with claim 1, wherein an opening communicating with outside air is provided in the vicinity of said capsule discharge port in said connection chute of said capsule transfer section, and said opening is configured to discharge the air flow for capsule transfer, flowing inside said connection chute, to outside air.

13. The capsule filling-sealing apparatus in accordance with claim 1, wherein a crack prevention guide is provided at the portion of delivering said filled capsules from said connection chute to said transfer roller of said capsule transfer section so that the vicinity of said capsule discharge port of said connection chute is communicated with a vacuum passage provided in said transfer roller.

* * * * *